US010386883B2

(12) United States Patent
Inoue et al.

(10) Patent No.: US 10,386,883 B2
(45) Date of Patent: Aug. 20, 2019

(54) FORCE-SENSE-IMPARTING OPERATION DEVICE

(71) Applicants: Kobe Steel, Ltd., Kobe-shi (JP); KOBELCO CRANES CO., LTD., Tokyo (JP)

(72) Inventors: Koji Inoue, Kobe (JP); Takashi Hiekata, Kobe (JP); Tatsurou Asano, Kobe (JP)

(73) Assignees: Kobe Steel, Ltd., Kobe-shi (JP); KOBELCO CRANES CO., LTD., Tokyo (JP)

( * ) Notice: Subject to any disclaimer, the term of this patent is extended or adjusted under 35 U.S.C. 154(b) by 499 days.

(21) Appl. No.: 14/916,030

(22) PCT Filed: Aug. 25, 2014

(86) PCT No.: PCT/JP2014/072091
§ 371 (c)(1),
(2) Date: Mar. 2, 2016

(87) PCT Pub. No.: WO2015/033807
PCT Pub. Date: Mar. 12, 2015

(65) Prior Publication Data

US 2016/0216726 A1 Jul. 28, 2016

(30) Foreign Application Priority Data

Sep. 6, 2013 (JP) ..... 2013-185244
Apr. 25, 2014 (JP) ..... 2014-091978

(51) Int. Cl.
*G05G 5/03* (2008.04)
*G05G 1/04* (2006.01)

(52) U.S. Cl.
CPC ..... *G05G 5/03* (2013.01); *G05G 1/04* (2013.01)

(58) Field of Classification Search
CPC ..... G05G 5/03; G05G 1/04
See application file for complete search history.

(56) References Cited

U.S. PATENT DOCUMENTS 4,719,381 A 1/1988 Miles
6,380,733 B1 4/2002 Apel et al.
(Continued)

FOREIGN PATENT DOCUMENTS

CN 102510241 A 6/2012
CN 103222164 A 7/2013
(Continued)

OTHER PUBLICATIONS

Extended European Search Report dated Jul. 25. 2017 in Patent Application No. 14843128.1.
(Continued)

*Primary Examiner* — Ramon M Barrera
(74) *Attorney, Agent, or Firm* — Oblon, McClelland, Maier & Neustadt, L.L.P.

(57) ABSTRACT

A force-sense-imparting operation device including a stationary section, a rotating section, and an operation member. One of the stationary section and the rotating section includes an excitation coil and a first magnetic pole section, and the other includes a second magnetic pole section capable of opposition to the first magnetic pole section in a specific opposing direction. The first magnetic pole section forms a magnetic circuit with the first magnetic pole section due to the second magnetic pole section being excited in a state that the second magnetic pole section opposes the first magnetic pole section. The magnetic circuit encircles a periphery of the excitation coil on the cross section, the second magnetic pole section being arranged to separate from the first magnetic pole section with rotation of the rotating section.

12 Claims, 16 Drawing Sheets

(56) References Cited

U.S. PATENT DOCUMENTS

| | | | |
|---|---|---|---|
| 6,664,666 | B2 | 12/2003 | Corcoran |
| 2002/0057152 | A1 | 5/2002 | Elferich et al. |
| 2010/0241332 | A1 | 9/2010 | Andrieu |
| 2013/0199881 | A1 | 8/2013 | Sano |
| 2013/0200744 | A1 | 8/2013 | Miyamura et al. |
| 2013/0220060 | A1 | 8/2013 | Sano et al. |

FOREIGN PATENT DOCUMENTS

| | | | |
|---|---|---|---|
| CN | 103244582 | A | 8/2013 |
| JP | 01-115051 | U | 8/1989 |
| JP | 2000-505922 | A | 5/2000 |
| JP | 2002-108470 | A | 4/2002 |
| JP | 2012-195150 | A | 10/2012 |

OTHER PUBLICATIONS

International Search Report dated Nov. 11, 2014, in PCT/JP 2014/072091 Filed Aug. 25, 2014.

FORCE-SENSE-IMPARTING OPERATION DEVICE

TECHNICAL FIELD

The present invention relates to a force-sense-imparting operation device that presents, when operating a working machine such as a crane, a force sense to an operator or the like through an operation member operated by the operator or the like.

BACKGROUND ART

Conventionally, a force-sense-imparting operation device (hereinafter, also simply referred to as an "operation device") described in Patent Literature 1 is known.

As shown in FIGS. 18 and 19, an operation device 100 includes a rotating section 101 supported so as to be rotatable around a center point c, an operation lever 103 for rotationally operating the rotating section 101, and a stationary section 104 that encircles a periphery of the rotating section 101 in a state where the rotating section 101 is rotatable.

The rotating section 101 has a magnetic pole section 102 that extends toward the stationary section 104 from the center point c. The magnetic pole section 102 is formed by a permanent magnet. The stationary section 104 has a plurality of stators 105 which extend toward the center point c and which are aligned at intervals in a rotational direction of the rotating section 101 and an excitation coil 106 formed by distributed winding of conducting wires around the plurality of stators 105.

In the operation device 100, when an excitation current supplied to the excitation coil 106 is controlled, each stator 105 constructs a magnetic pole on the side of the stationary section 104. As a result, a magnetic attraction force acts on the magnetic pole (permanent magnet) 102 of the rotating section 101. A torque around the center point c created at the rotating section 101 by the magnetic attraction force is used as a force sense that is perceived by an operator or the like when operating the operation lever 103.

However, with the operation device 100 described above, an expensive magnet such as a neodymium magnet is used as the permanent magnet 102 in order to obtain a large force sense (torque). This results in significantly high cost. In addition, with the operation device 100 described above, demagnetization of the permanent magnet 102 may occur when an overcurrent is supplied to the excitation coil 106 at short-time rating or the like to form a strong magnetic field. Furthermore, when the excitation coil 106 is heated by an overcurrent flowing through the excitation coil 106 or when the operation device 100 is used in a high-temperature atmosphere, the permanent magnet 102 is exposed to high temperature and, consequently, demagnetization or neutralization of the permanent magnet 102 may occur.

CITATION LIST

Patent Literature

Patent Document 1: U.S. Pat. No. 6,664,666B2

SUMMARY OF INVENTION

An object of the present invention is to provide a force-sense-imparting operation device capable of imparting a force sense to an operation member without using a permanent magnet.

A force-sense-imparting operation device according to an aspect of the present invention is a force-sense-imparting operation device which creates a force sense using torque generated by a magnetic force, the force-sense-imparting operation device including: a stationary section; a rotating section which is rotatable with respect to the stationary section; and an operation member for rotationally operating the rotating section, wherein one of the stationary section and the rotating section has an excitation coil and at least one first magnetic pole section at which magnetic flux lines concentrate when the first magnetic pole section is excited by the excitation coil, the other of the stationary section and the rotating section has at least one second magnetic pole section which is capable of opposition to the first magnetic pole section in a specific opposing direction, the excitation coil has an opposing site which opposes the second magnetic pole section, the first magnetic pole section has a shape which encircles the excitation coil with the exception of the opposing site in a cross section perpendicular to a direction of flow of an excitation current in the excitation coil, and the second magnetic pole section has a shape which forms a clearance in the opposing direction between the second magnetic pole section, and the excitation coil and the first magnetic pole section when the second magnetic pole section opposes the first magnetic pole section and which forms a magnetic circuit in cooperation with the first magnetic pole section so as to encircle a periphery of the excitation coil on the cross section due to the second magnetic pole section being excited by the excitation coil in a state where the second magnetic pole section opposes the first magnetic pole section, the second magnetic pole section being arranged so as to separate from the first magnetic pole section with rotation of the rotating section.

DESCRIPTION OF EMBODIMENTS

Hereinafter, an embodiment of the present invention will be described with reference to the drawings.

A force-sense-imparting operation device (hereinafter, also simply referred to as an "operation device") is a device for operating a working machine or the like. The operation device performs force sense presentation to an operator or the like through an operation member such as an operation lever when the operator or the like is operating the operation member. In other words, it is possible to cause the operator or the like to perceive force sense information. For example, the operation device according to the present embodiment is used for a hoisting operation by a crane or the like.

Figure 1:
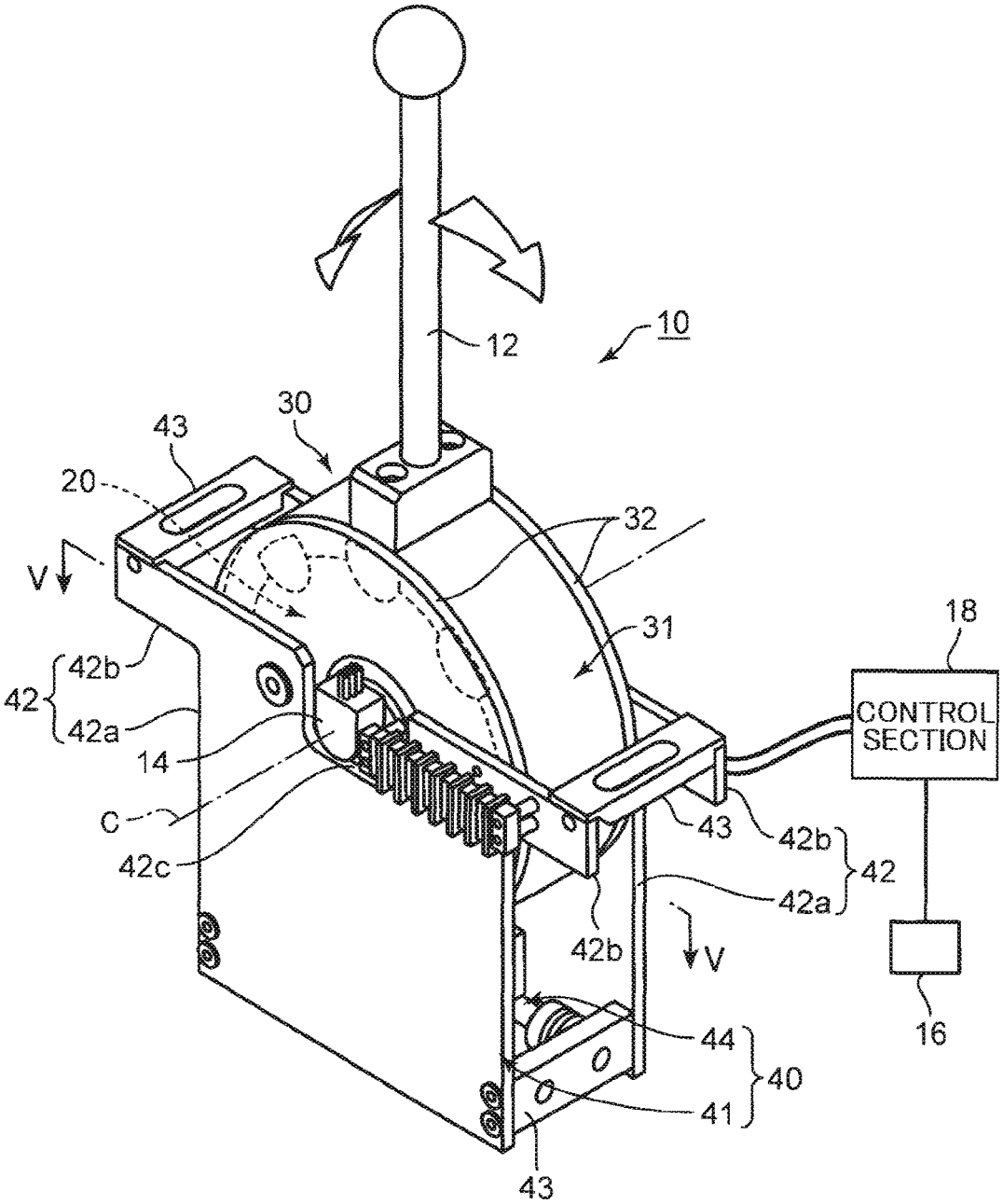
FIG. 1 is a perspective view of a force-sense-imparting operation device according to an embodiment of the present invention.

The operation device performs force sense presentation using a torque generated based on a drive principle of a switched reluctance motor. As shown in FIG. 1, an operation device 10 includes a stator section (stationary section) 20, a rotor section (rotating section) 30 rotatable around a rotational axis C, an operation lever (operation member) 12, a holder section 40, a rotation angle detecting section 14, a load detecting section 16, and a control section 18. In the following description, the rotational axis C of the rotor section 30 will be simply referred to as the "rotational axis C" and a rotational direction of the rotor section 30 will be simply referred to as the "rotational direction" or the "circumferential direction". In addition, positions of the rotor section 30 and the operation lever 12 as well as respective components that are rotatable with the rotor section 30 and the operation lever 12 when the operation lever 12 is arranged so as to extend vertically upward as shown in FIG. 1 are assumed to be neutral positions.

The stator section 20 includes an excitation coil 21 and a stator (a stationary section main body) 22. The stator section 20 is fixed to the holder section 40.

The excitation coil 21 is a coil formed by simply winding a conducting wire such as copper wire. The excitation coil 21 magnetizes the stator 22 as an excitation current flows through (as an excitation current is supplied to) the excitation coil 21. Moreover, the excitation coil 21 may be a so-called pancake coil in which a strip-like conducting wire is wound flatwise.

The stator 22 includes a shaft section 23 and a pair of large diameter sections 24. The shaft section 23 and the pair of large diameter sections 24 are integrally constructed and are formed by, for example, a material (a soft magnetic material) with high permeability such as soft iron.

The shaft section 23 has a cylindrical shape with the rotational axis C as its central axis. An outer diameter of the shaft section 23 is equal to an inner diameter of the excitation coil 21. The large diameter sections 24 are sites that spread outward in a radial direction from both end sections of the shaft section 23 in a direction of the rotational axis C. The direction of the rotational axis C refers to a direction in which the rotational axis C extends. In addition, the radial direction refers to a radial direction of the shaft section 23 or a radial direction of the rotor section 30. A plurality of notches 25 arranged at equal intervals in the circumferential direction are respectively formed in each large diameter section 24. In other words, in each large diameter section 24, a plurality of protruded sections 26 that protrude outward in the radial direction are arranged at equal intervals in the circumferential direction. Moreover, each protruded section 26 corresponds to a site between adjacent notches 25. A tip surface 27 of each protruded section 26 is positioned on a common circle centered on the rotational axis C when viewed in the direction of the rotational axis C. The number of protruded sections 26 is the same in the respective large diameter sections 24. Corresponding protruded sections 26 in the pair of large diameter sections 24 oppose each other (are arranged) in the direction of the rotational axis C. Each large diameter section 24 in the present embodiment is provided with, for example, eight protruded sections 26.

Figure 3:
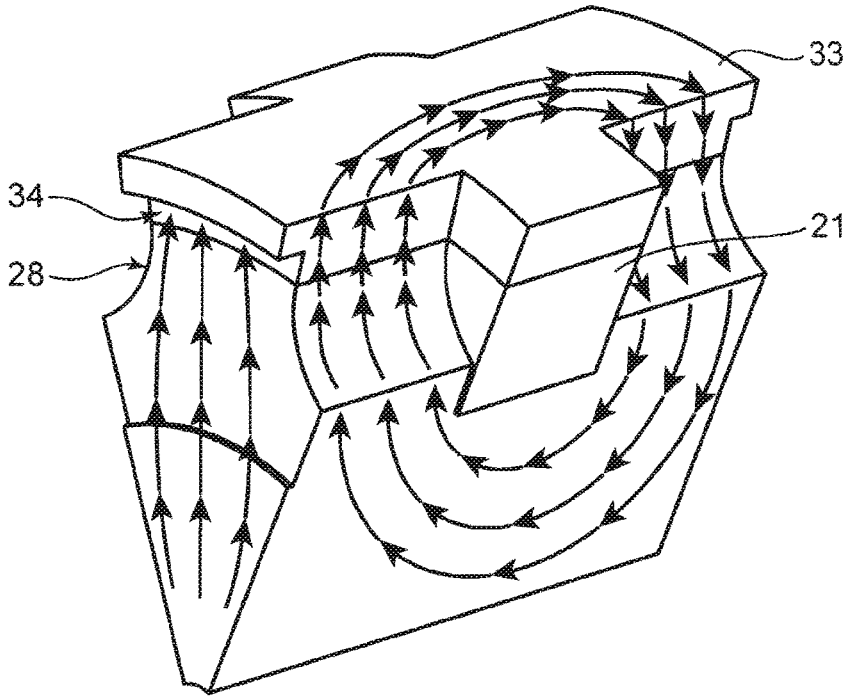
FIG. 3 is a diagram showing a distribution of magnetic flux lines when a stator-side magnetic pole section and a rotor-side magnetic pole section oppose each other.

In the stator 22 configured as described above, the excitation coil 21 is arranged to as to encircle the shaft section 23 between the pair of large diameter sections 24. The excitation coil 21 has an opposing site that opposes the rotor section 30 in a radial direction. When an excitation current is supplied to the excitation coil 21 in a state where the excitation coil 21 is arranged as described above, the stator 22 formed by a soft magnetic material is magnetized. At this point, magnetic flux lines concentrate in a specific region of the stator 22. As shown in FIG. 3, the specific region of the stator 22 is a region which includes a pair of protruded sections 26 that oppose each other across the shaft section 23 and which encircles three sides of the excitation coil 21 with the exception of the opposing site of the excitation coil 21. The specific region constitutes a stator-side magnetic pole section 28 as a magnetic pole section of the stator 22. In addition, the tip surface 27 of each protruded section 26 constitutes a stator-side magnetic pole surface that is a magnetic pole surface of the stator-side magnetic pole section 28.

The rotor section 30 includes a rotor 31 and a pair of side plates 32. The rotor section 30 is attached so as to be rotatable around the rotational axis C with respect to the holder section 40. In other words, the rotor section 30 is rotatable with respect to the stator section 20 that is fixed to the holder section 40.

Figure 4:
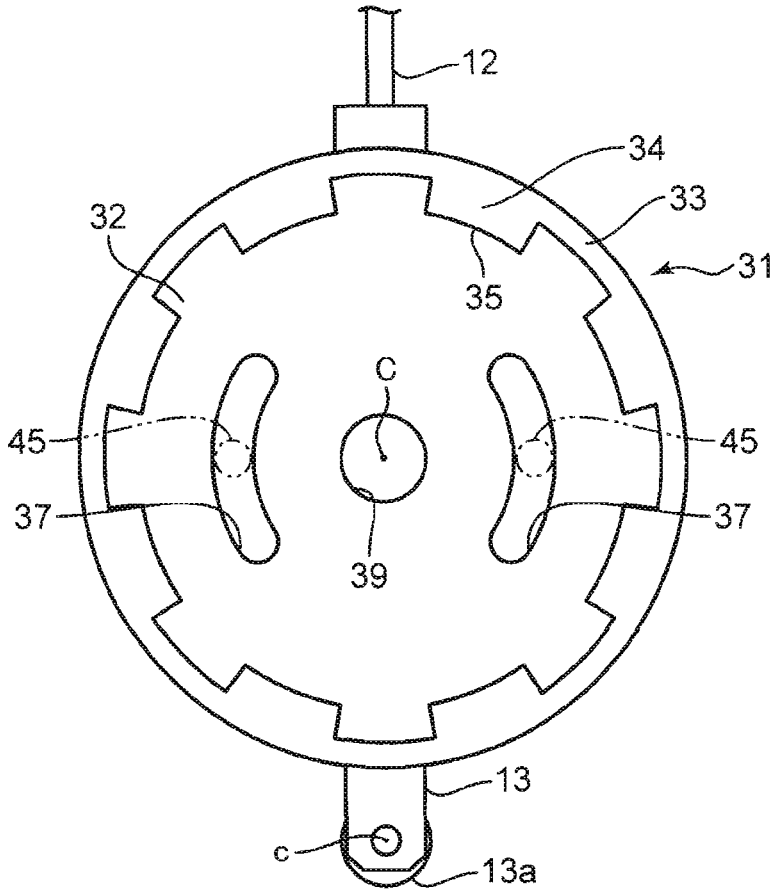
FIG. 4 is a diagram for explaining a rotor section.
Figure 5:
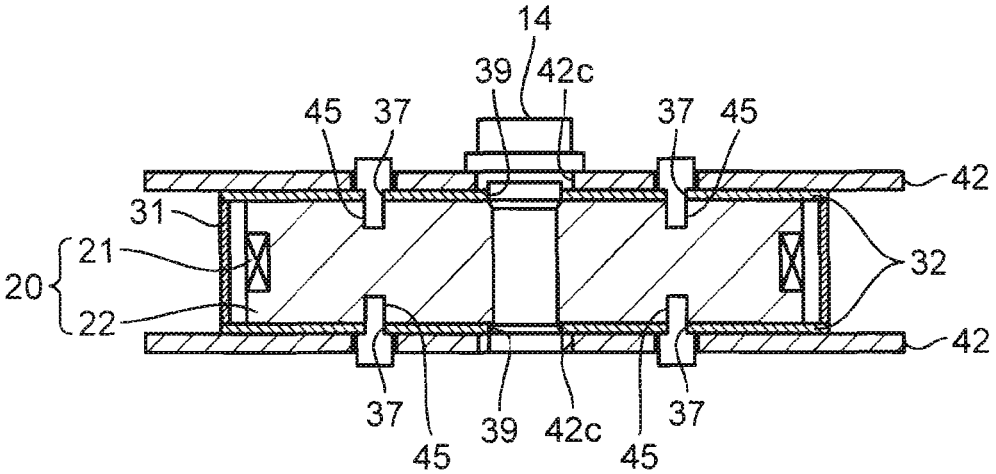
FIG. 5 is a sectional view at position V-V in FIG. 1.

As also shown in FIGS. 4 and 5, the rotor 31 includes a rotor main body 33 and a plurality of rotor-side magnetic pole sections (second magnetic pole sections) 34. For example, the rotor 31 is formed by a material (a soft magnetic material) with high permeability such as soft iron.

The rotor main body 33 encircles the stator section 20 in a circumferential direction at an outer side of the stator section 20 in a state where a clearance is provided in a radial direction of the shaft section 23 with respect to the stator section 20. The rotor main body 33 according to the present embodiment has a cylindrical shape. In addition, the rotor main body 33 according to the present embodiment has a length dimension in the direction of the rotational axis C that is approximately the same as a length dimension of the stator section 20 in the direction of the rotational axis C.

Each rotor-side magnetic pole section 34 has a protruded shape which protrudes from the rotor main body 33 toward the stator 22 (the rotational axis C) and which extends in the direction of the rotational axis C. Each rotor-side magnetic pole section 34 has, on a tip (an end portion on a side of the rotational axis C) thereof, a rotor-side magnetic pole surface 35 that becomes parallel to the stator-side magnetic pole surface 27 across a prescribed clearance when the rotor-side magnetic pole section 34 opposes the stator-side magnetic pole section 28. Accordingly, when the rotor 31 rotates so that the rotor-side magnetic pole surface 35 is arranged at a position directly in front of the stator-side magnetic pole surface 27, the rotor-side magnetic pole section 34 encircles four sides (periphery) of the excitation coil 21 in cooperation with the stator-side magnetic pole section 28 in a state where a clearance is created in a radial direction with respect to the stator-side magnetic pole section 28 and the excitation coil 21 on a plane passing through the rotational axis C, the stator-side magnetic pole section 28, and the rotor-side magnetic pole section 34. The plane passing through the rotational axis C, the stator-side magnetic pole section 28, and the rotor-side magnetic pole section 34 corresponds to a plane including a cross section perpendicular to a direction of flow of an excitation current in the excitation coil 21. Accordingly, when the stator-side magnetic pole section 28 and the rotor-side magnetic pole section 34 are excited by the excitation coil 21, a magnetic circuit enclosing the excitation coil 21 on the plane is formed.

The rotor-side magnetic pole section 34 configured as described above is provided in the same number as the number of stator-side magnetic pole sections 28 (the protruded sections 26 of the stator section 20) and are arranged at equal intervals in the circumferential direction. Due to the rotor-side magnetic pole section 34 being arranged in this manner, when one rotor-side magnetic pole surface 35 opposes a corresponding stator-side magnetic pole surface 27, the remaining rotor-side magnetic pole surfaces 35 oppose corresponding stator-side magnetic pole surfaces 27, respectively.

The pair of side plates 32 is a pair of members for attaching the rotor 31 to the holder section 40 so that the rotor 31 is rotatable. The pair of side plates 32 is arranged so as to sandwich the rotor 31 in the direction of the rotational axis C. Each side plate 32 spreads in a direction perpendicular to the rotational axis C. Each side plate 32 has a disk shape with a circular outline whose outer diameter is equal to an outer diameter of the rotor main body 33. In addition, a pair of arc-shaped guide holes 37 and a circular hole 39 are formed on each side plate 32. The pair of guide holes 37 is arranged at positions that oppose each other across the rotational axis C (a center of the side plate 32) on each side plate 32. Each arc-shaped guide hole 37 is formed on a circle having a diameter that is approximately half of a diameter of the side plate 32. The circular hole 39 has a circular shape. The circular hole 39 is arranged at a center portion of each side plate 32.

Figure 2:
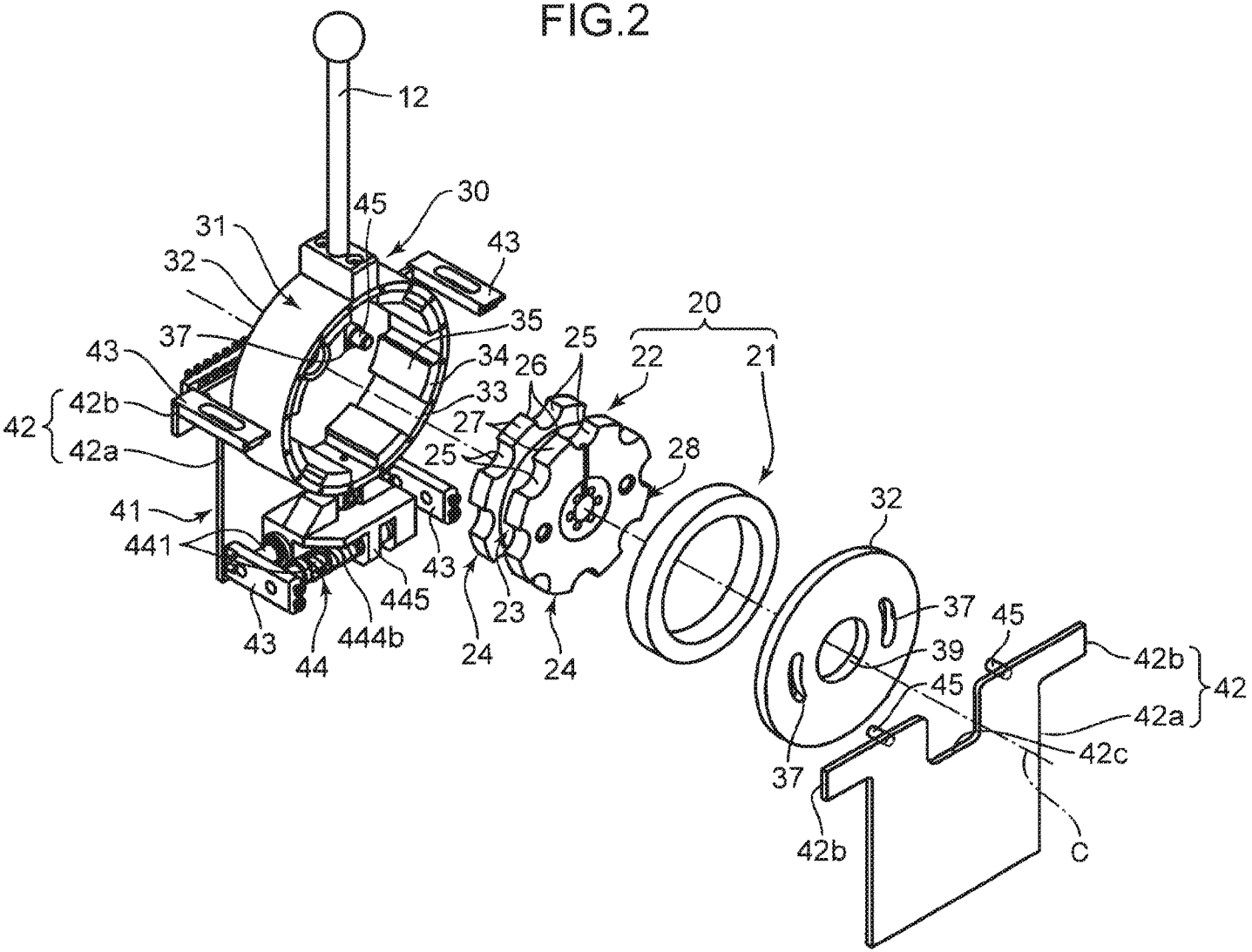
FIG. 2 is an exploded perspective view of a force-sense-imparting operation device according to the embodiment.

As is apparent from FIGS. 2 and 5, a plate engagement section 45 provided at a corresponding position of the holder section 40 is respectively inserted to (engaged with) the pair of arc-shaped guide holes 37. Accordingly, the rotor section 30 is made rotatable with respect to the holder section 40.

The operation lever 12 extends outward from an outer peripheral surface of the rotor 31 in a radial direction of the outer peripheral surface. By rotationally operating the operation lever 12 or, in other words, by tilting the operation lever 12 with the rotational axis C as a center of rotation, the rotor section 30 rotates with respect to the stator section 20.

In addition, a neutral position-returning engagement section 13 extending downward is attached to a lower end of the outer peripheral surface of the rotor 31 in a neutral position. The neutral position-returning engagement section 13 engages with a neutral position returning section 44 (to be described later). The neutral position-returning engagement section 13 has, at a lower end thereof, a roller section 13*a* rotatable around an axis c that is parallel to the rotational axis C as a center of rotation.

The holder section 40 includes: a holder main body 41 that holds the stator section 20 and the rotor section 30; and the neutral position returning section 44 that returns the rotor section 30 to the neutral position.

The holder main body 41 includes a pair of supporting plates 42 and a plurality of clearance maintaining members 43 that maintain a clearance between the pair of supporting plates 42.

Each of the pair of supporting plates 42 is a plate-like member that spreads in a direction perpendicular to the rotational axis C. The pair of supporting plates 42 is erected parallel to each other across a clearance in the direction of the rotational axis C which enables the stator section 20 and the rotor section 30 to be positioned between the pair of supporting plates 42. The supporting plate 42 according to the present embodiment includes a main body section 42*a* and extending sections 42*b*. The main body section 42*a* forms an approximately rectangular shape when viewed in the direction of the rotational axis C. The extending sections 42*b* extend outward from both sides of an upper end portion of the main body section 42*a* in a horizontal direction along an upper edge of the main body section 42*a*. A notch 42*c* depressed downward so as to avoid the rotational axis C and a periphery thereof is respectively provided at a center position in a direction along the upper edge of the main body section 42*a* of the upper end portion of each main body section 42*a*.

In addition, each supporting plate 42 is provided with a pair of plate engagement sections 45. The pair of plate engagement sections 45 is arranged at positions which correspond to the arc-shaped guide holes 37 and which oppose each other across the rotational axis C on the supporting plate 42 where the plate engagement sections 45 are provided. The respective plate engagement sections 45 provided on one supporting plate 42 are made of columnar members that protrude from an inside surface of the one supporting plate 42 toward the other opposing supporting plate 42. The inside surface of the supporting plate 42 corresponds to a surface facing the side of the rotor 30 of the supporting plate 42. An outer diameter of the plate engagement section 45 is approximately equal to a width of the arc-shaped guide hole 37. By inserting each plate engagement section 45 into the corresponding arc-shaped guide hole 37 of each side plate 32, the rotor section 30 becomes rotatable with respect to the holder section 40 (the supporting plate 42).

Each clearance maintaining member 43 extends in the direction of the rotational axis C. The respective clearance maintaining members 43 are arranged between both side portions of upper ends (both extending sections 42*b*) and between both side portions of lower ends of the pair of supporting plates 42. The clearance maintaining member 43 provided between both side portions of the lower ends supports the neutral position returning section 44.

Figure 6A:
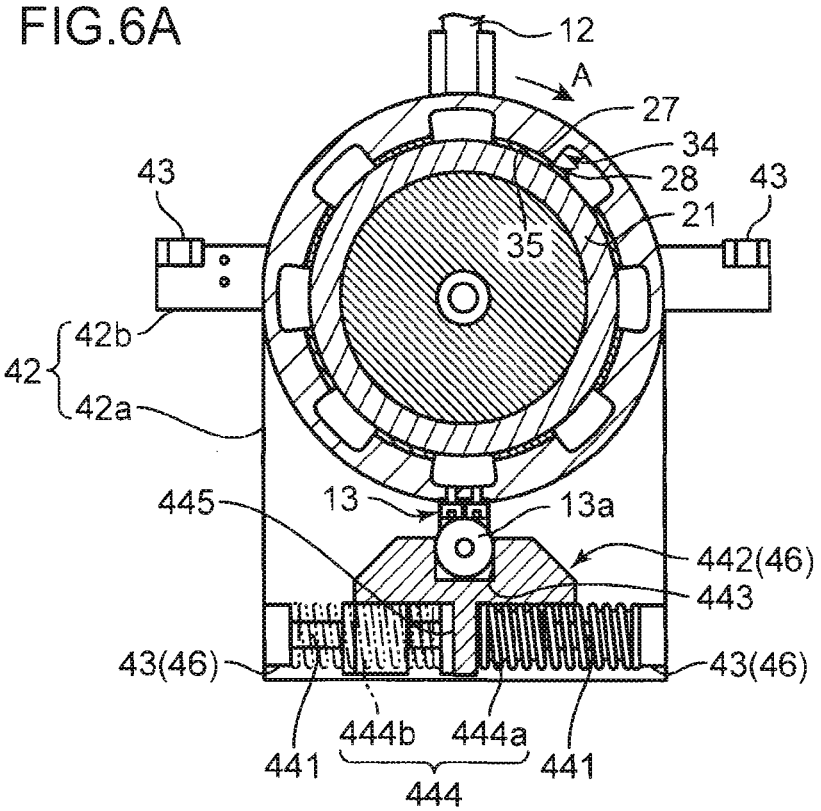
FIG. 6A is a diagram for explaining operations of a rotor section and a neutral position returning section.
Figure 6B:
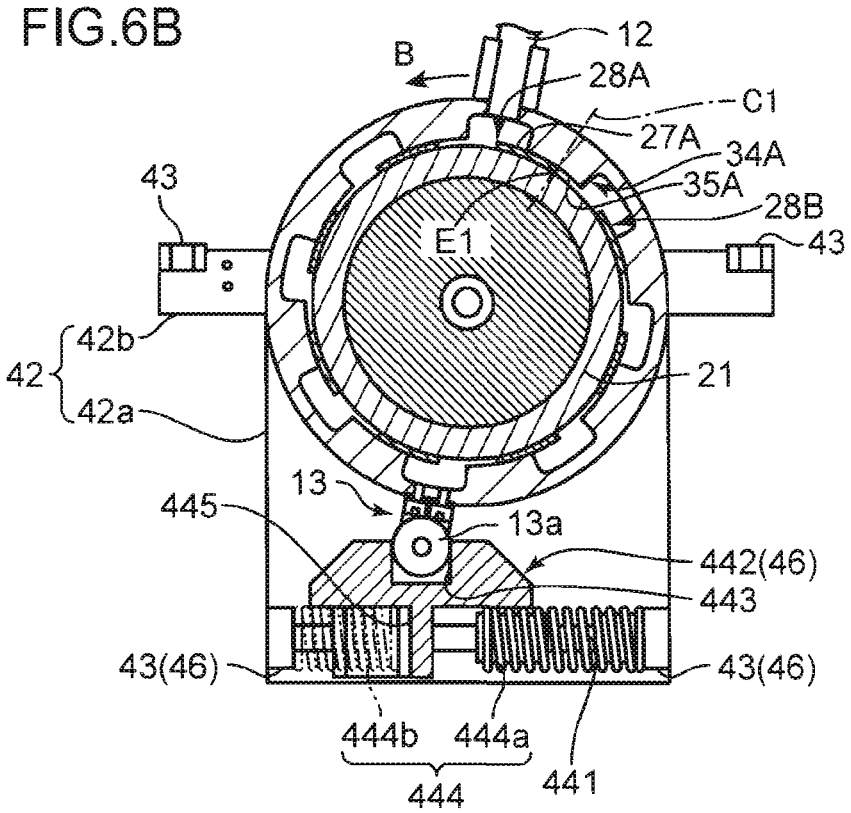
FIG. 6B is a diagram for explaining operations of a rotor section and a neutral position returning section.

As also shown in FIGS. 6A and 6B, the neutral position returning section 44 includes two guide members 441, a returning section main body 442, and a biasing member 444. The neutral position returning section 44 biases the rotor section 30 in a direction in which the rotor section 30 is returned to the neutral position.

Each guide member 441 extends in a horizontal direction that is perpendicular to the rotational axis C. Each guide member 441 bridges the clearance maintaining members 43 provided at both end portions of the lower ends of the supporting plates 42. In the present embodiment, two guide members 441 are arranged parallel to each other at an interval in the direction of the rotational axis C.

The returning section main body 442 includes an engagement groove 443 at a center position of an upper portion of the returning section main body 442. The engagement groove 443 is depressed downward and extends in the direction of the rotational axis C. The neutral position-returning engagement section 13 fits into the engagement groove 443. The guide member 441 is inserted into a lower portion of the returning section main body 442. Accordingly, the returning section main body 442 is guided by the guide member 441 so as to reciprocate in an axial direction of the guide member 441.

The biasing member 444 biases the returning section main body 442 toward the neutral position. The biasing member 444 according to the present embodiment is constituted by two compression coil springs 444*a* and 444*b*. Each of the compression coil springs 444*a* and 444*b* is attached to the guide member 441 in a state where the guide member 441 is inserted through each compression coil spring along a coil axis of the compression coil spring. Specifically, for example, one compression coil spring 444*a* is attached to the guide member 441 on a front side on a paper plane in FIGS. 6A and 6B and is arranged between a pressing section 445 at a center of a lower portion of the returning section main body 442 and a right-side clearance maintaining member 43. The pressing section 445 is a plate-like site that spreads in a direction perpendicular to the axial direction of the guide member 441 at the center of the lower portion of the returning section main body 442. The two guide members 441 penetrate a center portion of the pressing section 445. As the returning section main body 442 moves from the neutral position toward a right side, one compression coil spring 444*a* is compressed in accordance with a distance of the movement of the returning section main body 442 and biases the pressing section 445 toward center by a resilient force attributable to the compression. In other words, one compression coil spring 444*a* biases the pressing section 445 toward the neutral position. In addition, the other compression coil spring 444*b* is attached to the guide member 441 on a rear side on the paper plane in FIGS. 6A and 6B and is arranged between the pressing section 445 and a left-side clearance maintaining member 43. Furthermore, as the returning section main body 442 moves from the neutral position toward a left side as shown in FIG. 6B, the other compression coil spring 444*b* is compressed in accordance with a distance of the movement of the returning section main body 442 and biases the pressing section 445 toward the center (toward the neutral position) by a resilient force attributable to the compression.

As shown in FIG. 6B, due to rotation of the rotor section 30, the returning section main body 442 is pushed by the roller section 13*a* fitted inside the engagement groove 443 so as to move along the guide member 441. In addition, when the rotor section 30 rotates by a prescribed angle from the neutral position, an end portion of the returning section main body 442 abuts the clearance maintaining member 43 so that movement of the returning section main body 442 is restricted. As a result, further rotation of the rotor section 30 is restricted. In this manner, a width dimension of the returning section main body 442 in the axial direction of the guide member 441 (a left-right direction in FIG. 6A) is set based on a range where rotation of the rotor section 30 is permitted. Hereinafter, the range where rotation of the rotor section 30 is permitted will sometimes be referred to as a permissible rotational range. Therefore, in the present embodiment, the operation device 10 includes a rotation angle restricting mechanism 46 which restricts a rotation angle of the rotor section 30 to the permissible rotational range and which is constituted by the returning section main body 442 and the clearance maintaining members 43. The rotation angle restricting mechanism 46 is an example of the rotation angle restricting section according to the present invention. Moreover, a specific configuration of a mechanism for restricting a rotation angle of the rotor section 30 to the permissible rotational range is not limited to the configuration of the rotation angle restricting mechanism 46 described above.

The permissible rotational range according to the present embodiment is, for example, a rotation angle range from the neutral position to ±11°. An upper limit and a lower limit of this rotation angle range correspond to positions where a center position of the rotor-side magnetic pole surface 35 in a rotational direction overlaps, in a radial direction, with an end portion of the stator-side magnetic pole surface 27 corresponding to the rotor-side magnetic pole surface 35, the end portion being an end portion of the stator-side magnetic pole surface 27 in a direction of rotation of the rotor section 30 from the neutral position. Specifically, when the rotor section 30 is arranged at a position corresponding to the upper limit or the lower limit of the rotation angle range, a state such as that shown in FIG. 6B is created.

FIG. 6B shows one of the plurality of rotor-side magnetic pole surfaces 35 denoted by reference character 35A and the stator-side magnetic pole surface 27 corresponding to the one rotor-side magnetic pole surface 35A, the stator-side magnetic pole surface 27 being denoted by reference character 27A. Moreover, the stator-side magnetic pole surface 27A corresponding to the rotor-side magnetic pole surface 35A refers to the stator-side magnetic pole surface 27A that opposes the rotor-side magnetic pole surface 35A in the radial direction. In addition, the center position of the rotor-side magnetic pole surface 35A in the rotational direction is denoted by reference character C1 and the end portion of the stator-side magnetic pole surface 27A in a direction of rotation of the rotor section 30 from the neutral position is denoted by reference character E1. As shown in FIG. 6B, in the state described above, the center position C1 of the rotor-side magnetic pole surface 35A overlaps with the end portion E1 of the corresponding stator-side magnetic pole surface 27A in the radial direction. The permissible rotational range of the rotor section 30 corresponds to a rotation angle range from the neutral position to the position shown in FIG. 6B and to a rotation angle range from the neutral position to a position reached when the rotor section 30 is rotated to an opposite side to the position shown in FIG. 6B by the same rotation angle.

Due to the permissible rotational range of the rotor section 30 set as described above, a magnetic attraction force received by the rotor-side magnetic pole section 34A from a stator-side magnetic pole section 28B that is adjacent to the stator-side magnetic pole section 28A corresponding to the rotor-side magnetic pole section 34A is reliably smaller than a magnetic attraction force received by the rotor-side magnetic pole section 34A from the stator-side magnetic pole section 28A corresponding to the rotor-side magnetic pole section 34A. As a result, the operation device 10 is capable of reliably preventing the occurrence of cogging. Moreover, the stator-side magnetic pole section 28A corresponding to the rotor-side magnetic pole section 34A refers to the stator-side magnetic pole section 28A that opposes the rotor-side magnetic pole section 34A in the radial direction.

The rotation angle detecting section 14 detects a rotation angle of the rotor section 30 from the neutral position and outputs a rotation angle signal representing the detected rotation angle to the control section 18. The rotation angle detecting section 14 is attached to a center portion of one of the side plates 32 so as to straddle the circular hole 39. Due to the rotation angle detecting section 14 being attached to the side plate 32 (the rotor section 30) in this manner, there is no need to separately provide a member or an arrangement space for arranging the rotation angle detecting section.

The rotation angle detecting section 14 detects a rotation angle of the rotor section 30 with respect to the stator section 20 exposed from the circular hole 39 when the rotation angle detecting section 14 rotates together with the side plate 32 (the rotor section 30). The rotation angle detecting section 14 according to the present embodiment is, for example, a rotary encoder.

The load detecting section 16 detects a load applied to a turning section of a crane such as a load on a turning hydraulic motor that turns the turning section and outputs a load signal representing the detected load to the control section.

The rotation angle signal from the rotation angle detecting section 14 and the load signal from the load detecting section 16 are input to the control section 18. The control section 18 adjusts an excitation current supplied to the excitation coil 21 based on these input signals. For example, based on a magnitude of the rotation angle detected by the rotation angle detecting section 14 and on a magnitude of the load detected by the load detecting section 16, the control section 18 according to the present embodiment increases the excitation current supplied to the excitation coil 21 by a prescribed rate according to an output conversion table (lookup table) defined in advance.

With the operation device 10 configured as described above, force sense presentation is performed with respect to an operator or the like who operates the operation lever 12 as described below.

The operator or the like tilts the operation lever 12 in, for example, a direction of an arrow A shown in FIG. 6A in order to turn a crane. In other words, the operator or the like rotationally operates the operation lever 12 in the direction of the arrow A. At this point, as the rotation angle detecting section 14 detects a rotation angle of the rotor section 30 and outputs a rotation angle signal corresponding to a detection result to the control section 18, the control section 18 having received input of the rotation angle signal supplies an excitation current with a magnitude in accordance with the detected rotation angle of the rotor section 30 to the excitation coil 21. Accordingly, a torque in a direction of the neutral position is created at the rotor section 30. As a result, the operator or the like perceives the torque as a force sense through the operation lever 12. Details are as described below.

When the rotor section 30 rotates from the neutral position with respect to the stator section 20 in a state where the excitation coil 21 is excited, magnetoresistance between the stator-side magnetic pole section 28 and the rotor-side magnetic pole section 34 increases. Due to the increase in magnetoresistance, a magnetic attraction force in an opposite direction to a direction of rotation of the rotor section 30 acts on the rotor section 30. Therefore, with the operation device 10, a torque can be created at the rotor section 30 without using a permanent magnet. Accordingly, a force sense can be imparted to the operation lever 12 that is used to rotationally operate the rotor section 30. Details are as described below.

When an excitation current is supplied to the excitation coil 21, magnetic flux lines created due to the excitation of the excitation coil 21 concentrate at the respective magnetic pole sections (the stator-side magnetic pole section 28 and the rotor-side magnetic pole section 34). Therefore, a magnetic circuit which passes through the stator-side magnetic pole section 28 and the rotor-side magnetic pole section 34 and which encircles the excitation coil 21 is formed (refer to FIG. 3). In a state where this magnetic circuit is formed, magnetoresistance between the rotor-side magnetic pole section 34 and the stator-side magnetic pole section 28 is smallest when the rotor section 30 rotates so that the rotor-side magnetic pole surface 35 is arranged at a position directly in front (an opposing position: refer to FIG. 6A) of the stator-side magnetic pole surface 27. On the other hand, in a state where the magnetic circuit is formed, magnetoresistance between the magnetic pole sections 28 and 34 increases as the rotor section 30 rotates so that the rotor-side magnetic pole section 34 moves away from the stator-side magnetic pole section 28. At this point, a magnetic attraction force acts in a direction that reduces the magnetoresistance between the magnetic pole sections 28 and 34. Therefore, a magnetic attraction force in a direction in which the rotor section 30 is returned to the neutral position acts so that a torque is created on the rotor section 30 having been rotated from the neutral position. Moreover, the direction in which the rotor section 30 is returned to the neutral position corresponds to a direction in which the rotor-side magnetic pole section 34 moves toward a position directly in front of the stator-side magnetic pole section 28. Due to the creation of such a torque at the rotor section 30, a force (the torque) in a direction (a direction denoted by an arrow B in FIG. 6B) that is opposite to the direction of the rotational operation is applied to the operation lever 12 having been rotationally operated by the operator or the like. This force is perceived by the operator or the like as a force sense.

In addition, with the operation device 10 according to the present embodiment, the greater the angle by which the operation lever 12 is tilted (rotationally operated), the greater the torque created at the rotor section 30. Furthermore, the greater the load during turning of a crane due to a factor such as a heavy load being hoisted by the crane, the greater the excitation current supplied to the excitation coil 21. Therefore, the greater the degree by which the operation lever is tilted and the greater the turning load of the crane, the greater the torque created at the rotor section 30. Accordingly, it becomes difficult to extensively tilt the operation lever 12 in one operation. As a result, danger caused by a sudden turn of the crane can be prevented. In addition, since the heavier the load, the more difficult it is to tilt the operation lever 12, a sudden turn of a heavy load by the crane can be prevented and, consequently, a large load can be prevented from being suddenly applied to a turning mechanism. Accordingly, damage to the mechanism due to such a sudden load can be prevented.

Moreover, in the present embodiment, when the rotor section 30 rotates from the neutral position, the neutral returning section 44 constantly biases the rotor section 30 in a direction of the neutral position. Therefore, the biasing force due to the neutral returning section 44 is also perceived by the operator or the like as a force sense together with the torque created at the rotor section 30. In addition, the neutral returning section 44 biases the rotor section 30 using resilient force of the compression coil springs 444*a* and 444*b*. Therefore, even in a state where an excitation current is not being supplied to the excitation coil 21, the rotor section 30 is biased in a direction in which the rotor section 30 is returned to the neutral position. In other words, with the operation device 10 according to the present embodiment, the operation lever 12 is returned to the neutral position once the operator or the like lets go of the operation lever 12 even in a state where power is not being supplied.

As described above, with the operation device 10 according to the present embodiment, a torque can be created at the rotor section 30 and a force sense can be imparted to the operation lever 12 without using a permanent magnet.

In addition, with the operation device 10, even during a current runaway where a current greater than a scheduled current is supplied to the excitation coil 21, only a torque in a direction where the rotor section 30 returns to a front position is created at the rotor section 30. Therefore, the operation lever 12 can be stopped at the neutral position. In other words, the operation lever 12 can be prevented from moving in an unintended direction even during a current runaway.

Furthermore, with the operation device 10 according to the present embodiment, a magnetic attraction force is generated for each combination of a stator-side magnetic pole section 28 and a rotor-side magnetic pole section 34 that correspond to each other. Therefore, a large torque can be efficiently generated at the rotor section 30.

Moreover, the force-sense-imparting operation device according to the present invention is not limited to the embodiment described above and, obviously, various modifications can be made without departing from the gist of the present invention.

Figure 7:
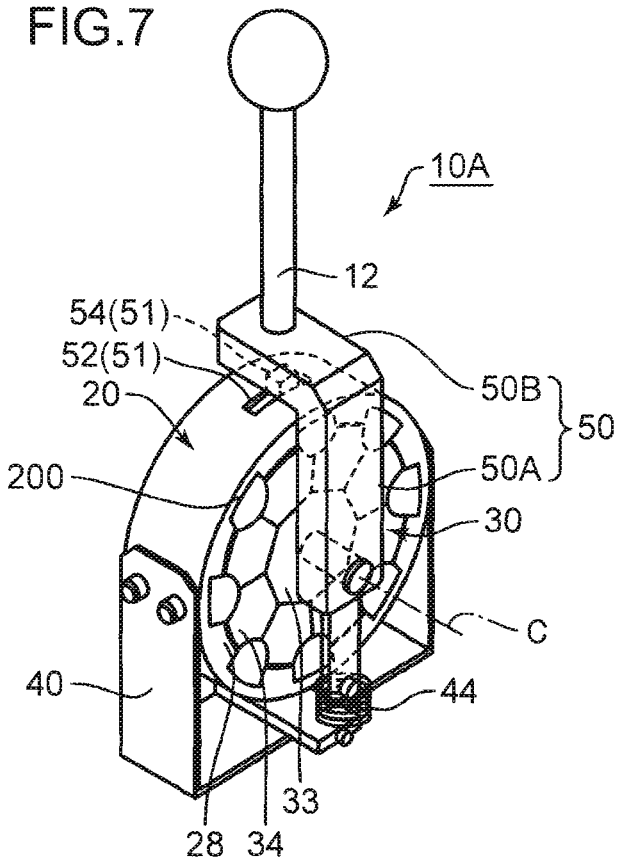
FIG. 7 is a perspective view of a force-sense-imparting operation device according to another embodiment of the present invention.
Figure 8:
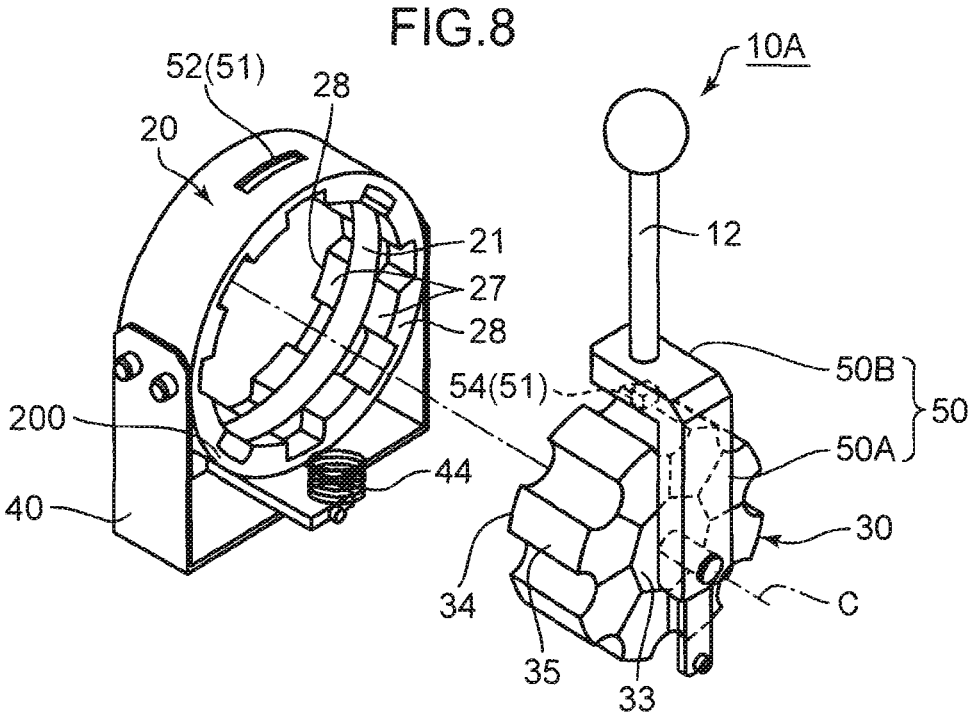
FIG. 8 is an exploded perspective view of a force-sense-imparting operation device according to the other embodiment.

While the stator section 20 is arranged on an inner side in the radial direction and a rotor section 30 is arranged on an outer side of the stator section 20 in the operation device 10 according to the present embodiment, the rotor section 30 may be arranged on an inner side in the radial direction and the stator section 20 may be arranged on an outer side in the radial direction as in the case of an operation device 10A shown in FIGS. 7 and 8. While a specific description will be given below, components that perform the same operations as the components of the operation device 10 according to the embodiment described above are denoted by the same reference characters.

In the operation device 10A, the rotor section 30 includes: the rotor main body 33 which is a center-side site of the rotor section 30; and the plurality of rotor-side magnetic pole sections 34 which protrude outward in the radial direction from a peripheral edge portion of the rotor main body 33 and which are arranged at intervals in a circumferential direction. In addition, the stator section 20 includes a stator main body 200, the plurality of stator-side magnetic pole sections 28, and the excitation coil 21. The stator main body 200 encircles the rotor section 30 in a circumferential direction at an outer side of the rotor section 30 across a clearance provided in a radial direction with respect to the rotor section 30. The respective stator-side magnetic pole sections 28 extend in the radial direction from the stator main body 200 toward the rotational axis C (the rotor section 30) and are arranged at intervals in the circumferential direction. The excitation coil 21 is arranged in a groove provided on a side of an inner peripheral surface of the stator main body 200 at a center portion of the stator-side magnetic pole section 28 in the direction of the rotational axis C.

With the operation device 10A, the operation lever 12 extends outward in the radial direction from a tip portion of an extended member 50. The extended member 50 includes a first site 50A that extends outward in the radial direction along a side surface of the rotor section 30 from a center portion of the side surface and a second site 50B that extends in the direction of the rotational axis C from a tip (an outer end portion in the radial direction) of the first site 50A across a prescribed clearance from an outer peripheral surface of the stator section 20. The operation lever 12 is attached to a tip portion of the second site 50B.

In addition, the neutral position returning section 44 is constituted by a helical spring connected to a lower end of an outer peripheral surface of the rotor section 30 and to a lower end of the holder section 40.

Figure 9A:
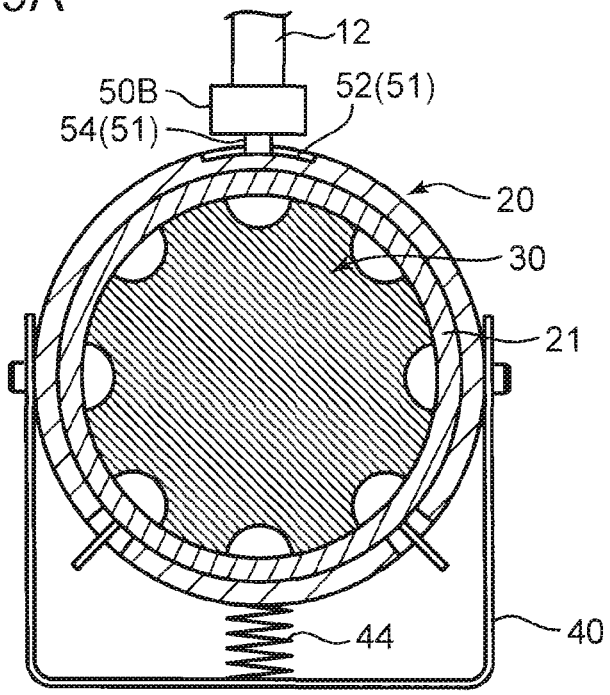
FIG. 9A is a diagram for explaining a mechanism that restricts a rotational range of a rotor section in a force-sense-imparting operation device according to the other embodiment.
Figure 9B:
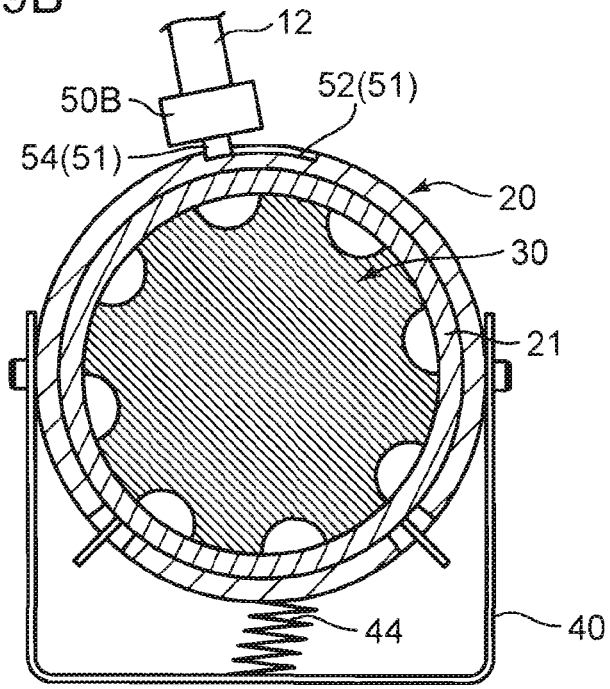
FIG. 9B is a diagram for explaining a mechanism that restricts a rotational range of a rotor section in a force-sense-imparting operation device according to the other embodiment.

Furthermore, the operation device 10A includes a mechanism that defines a permissible rotational range of the rotor section 30 or, more specifically, a rotation angle restricting mechanism 51 that restricts a rotation angle of the rotor section 30 to the permissible rotational range. The rotation angle restricting mechanism 51 is an example of the rotation angle restricting section according to the present invention. As also shown in FIGS. 9A and 9B, the rotation angle restricting mechanism 51 includes a sliding groove 52 which is provided on the outer peripheral surface of the rotor section 30 and which extends in the circumferential direction and a sliding member 54 which extends into the sliding groove 52 from a position corresponding to the sliding groove 52 on a tip of the second site 50B. With the rotation angle restricting mechanism 51, the sliding member 54 slides (moves) in the circumferential direction in the sliding groove 52 as the rotor section 30 rotates. In addition, as the sliding member 54 abuts an end portion of the sliding groove 52 as shown in FIG. 9B, further rotation of the rotor section 30 is restricted. In other words, the permissible rotational range of the rotor section 30 is determined by a length of the sliding groove 52 in the circumferential direction. Moreover, a specific configuration of a mechanism for restricting a rotation angle of the rotor section 30 to the permissible rotational range is not limited to the configuration of the rotation angle restricting mechanism 51 described above.

Figure 10:
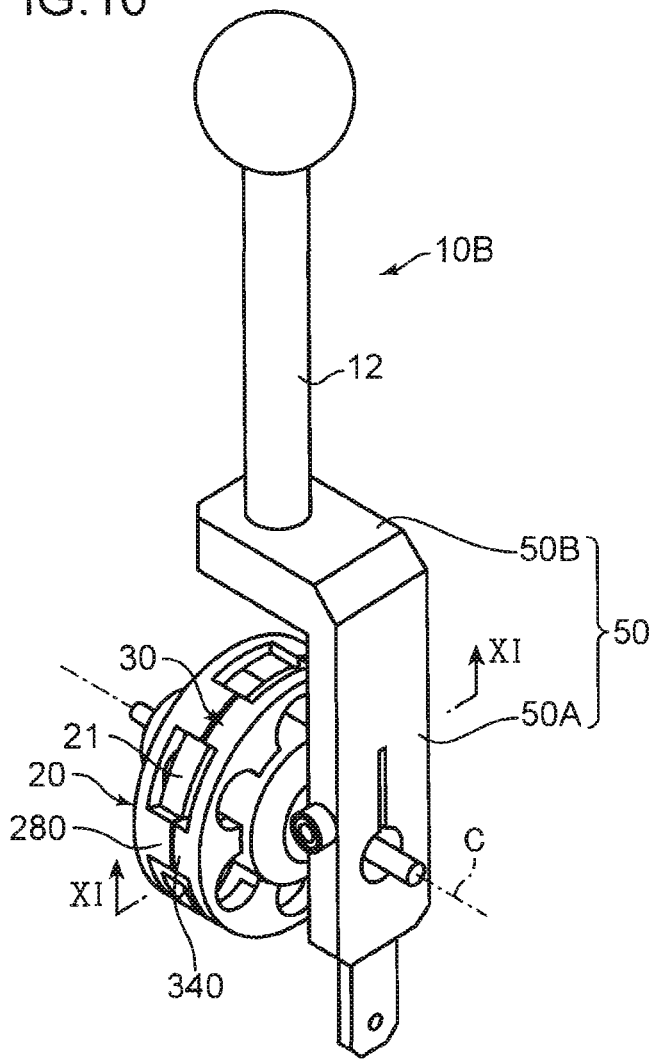
FIG. 10 is a perspective view of a force-sense-imparting operation device according to another embodiment.
Figure 11:
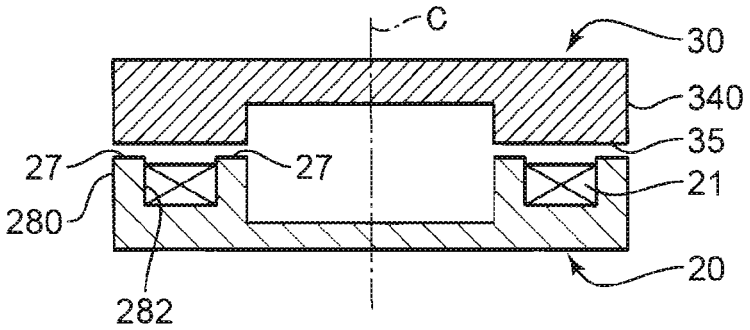
FIG. 11 is a schematic view of a cross section at position XI-XI in FIG. 10.

Furthermore, the operation device 10 according to the embodiment described above or the operation device 10A shown in FIG. 7 adopts a configuration where the rotor-side magnetic pole section 34 and the stator-side magnetic pole section 28 are separated from each other in the radial direction. In other words, the operation devices 10 and 10A adopt a configuration that utilizes a drive principle of a so-called radial gap-type switched reluctance motor. However, the configuration of an operation device according to the present invention is not limited to this configuration. For example, a configuration may be adopted in which a rotor-side magnetic pole section 340 and a stator-side magnetic pole section 280 are separated from each other in the direction of the rotational axis C (a direction in which the rotational axis C extends) as in the case of an operation device 10B shown in FIGS. 10 and 11. In other words, a configuration that utilizes a drive principle of a so-called axial gap-type switched reluctance motor may be adopted. A specific description will be given below. Moreover, components that perform the same operations as the components of the operation device 10 according to the embodiment described earlier and the operation device 10A described above are denoted by the same reference characters.

In the operation device 10B, the stator section 20 and the rotor section 30 are arranged in the direction of the rotational axis C. In other words, the stator section 20 and the rotor section 30 oppose each other in the direction of the rotational axis C. In addition, a plurality of rotor-side magnetic pole sections 340 are arranged at equal intervals in a circumferential direction on a peripheral edge portion of a surface of the rotor section 30 that opposes the stator section 20. Each rotor-side magnetic pole section 340 extends toward the stator section 20. Furthermore, a plurality of stator-side magnetic pole sections 280 are arranged at equal intervals in a circumferential direction on a peripheral edge portion of a surface of the stator section 20 that opposes the rotor section 30. Each stator-side magnetic pole section 280 extends toward the rotor section 30. A groove 282 in which the excitation coil 21 is to be arranged is formed in each stator-side magnetic pole section 280 at a center portion of the stator-side magnetic pole section 280 in the direction of the rotational axis C. The number of the stator-side magnetic pole sections 280 is the same as the number of the rotor-side magnetic pole sections 340. The rotor section 30 is rotatable around the rotational axis C with respect to the stator section 20. In addition, the rotor-side magnetic pole surface 35 at a tip of each rotor-side magnetic pole section 340 is respectively positioned on a common surface that is perpendicular to the rotational axis C. The stator-side magnetic pole surface 27 at a tip of each stator-side magnetic pole section 280 is respectively positioned on a common surface that is perpendicular to the rotational axis C. Furthermore, when the rotor-side magnetic pole section 340 is arranged at a position directly in front of the stator-side magnetic pole section 280, a gap (clearing) in the direction of the rotational axis C is formed between each rotor-side magnetic pole surface 35 and a corresponding stator-side magnetic pole surface 27.

Even with the operation device 10B, as the excitation coil 21 is excited, a magnetic attraction force acts between the rotor-side magnetic pole section 340 and the stator-side magnetic pole section 280 which correspond to each other. Accordingly, a torque in a direction where the rotor section 30 is returned to a neutral position is created at the rotor section 30. Subsequently, the operation device 10B causes the operator or the like to perceive the torque created in this manner through the operation lever 12 as a force sense.

Figure 12:
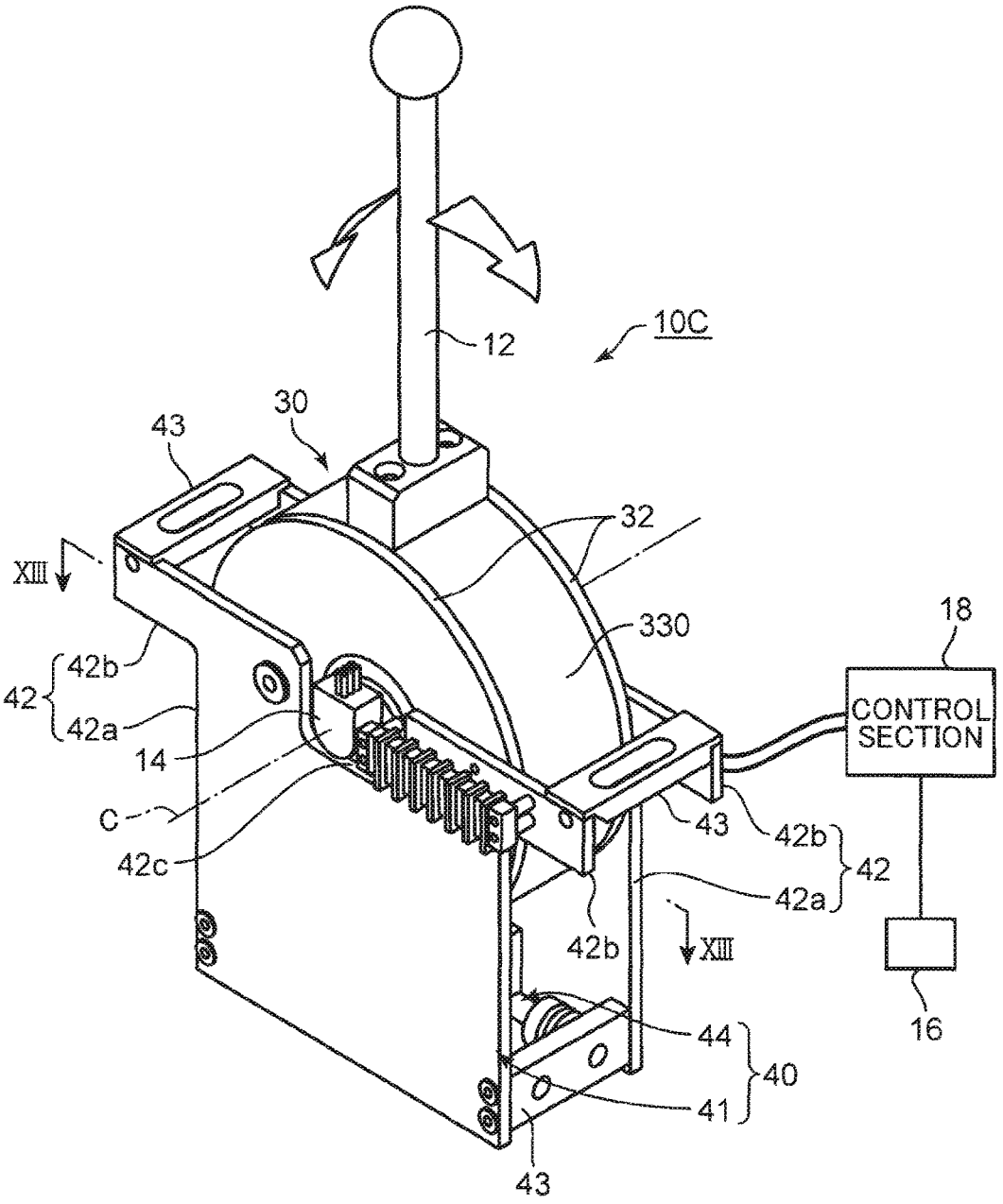
FIG. 12 is a perspective view of a force-sense-imparting operation device according to a modification.
Figure 13:
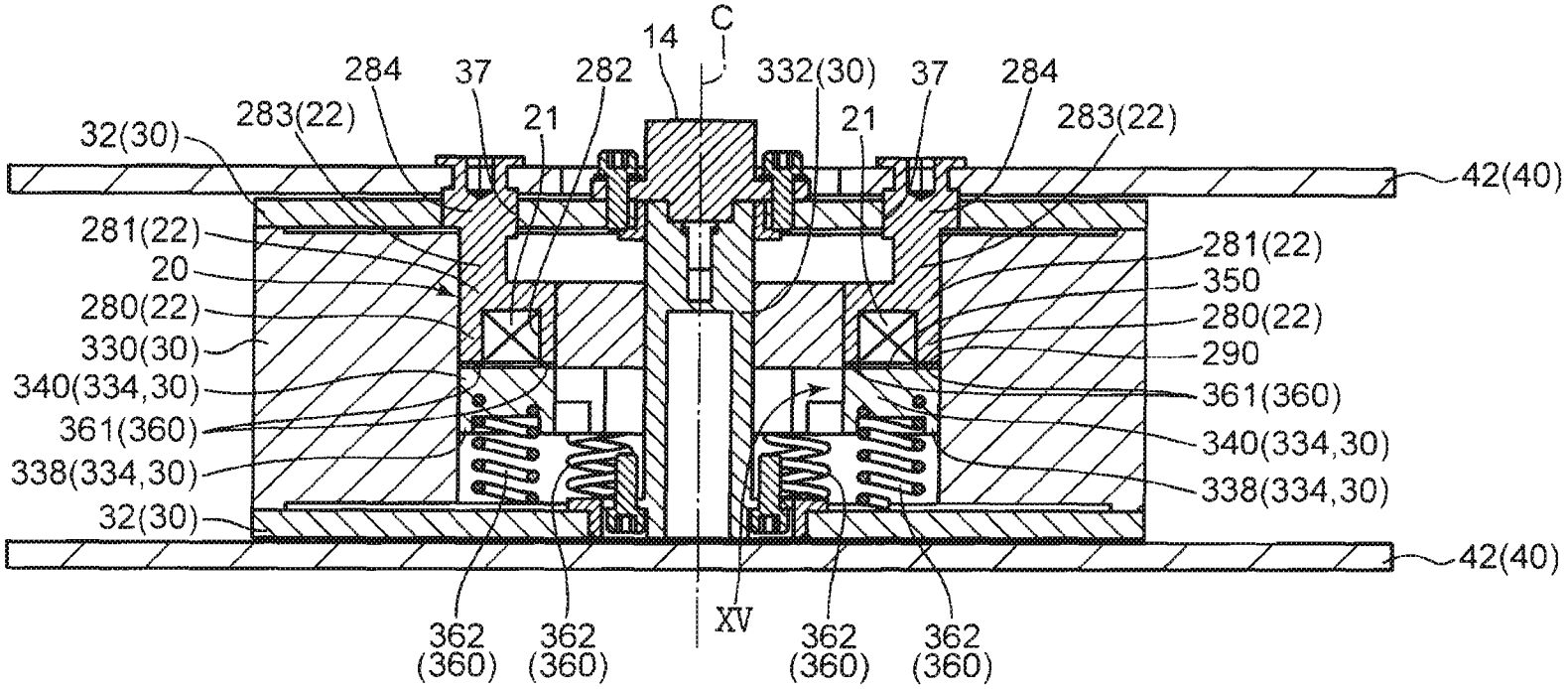
FIG. 13 is a sectional view at position XIII-XIII in FIG. 12.
Figure 14:
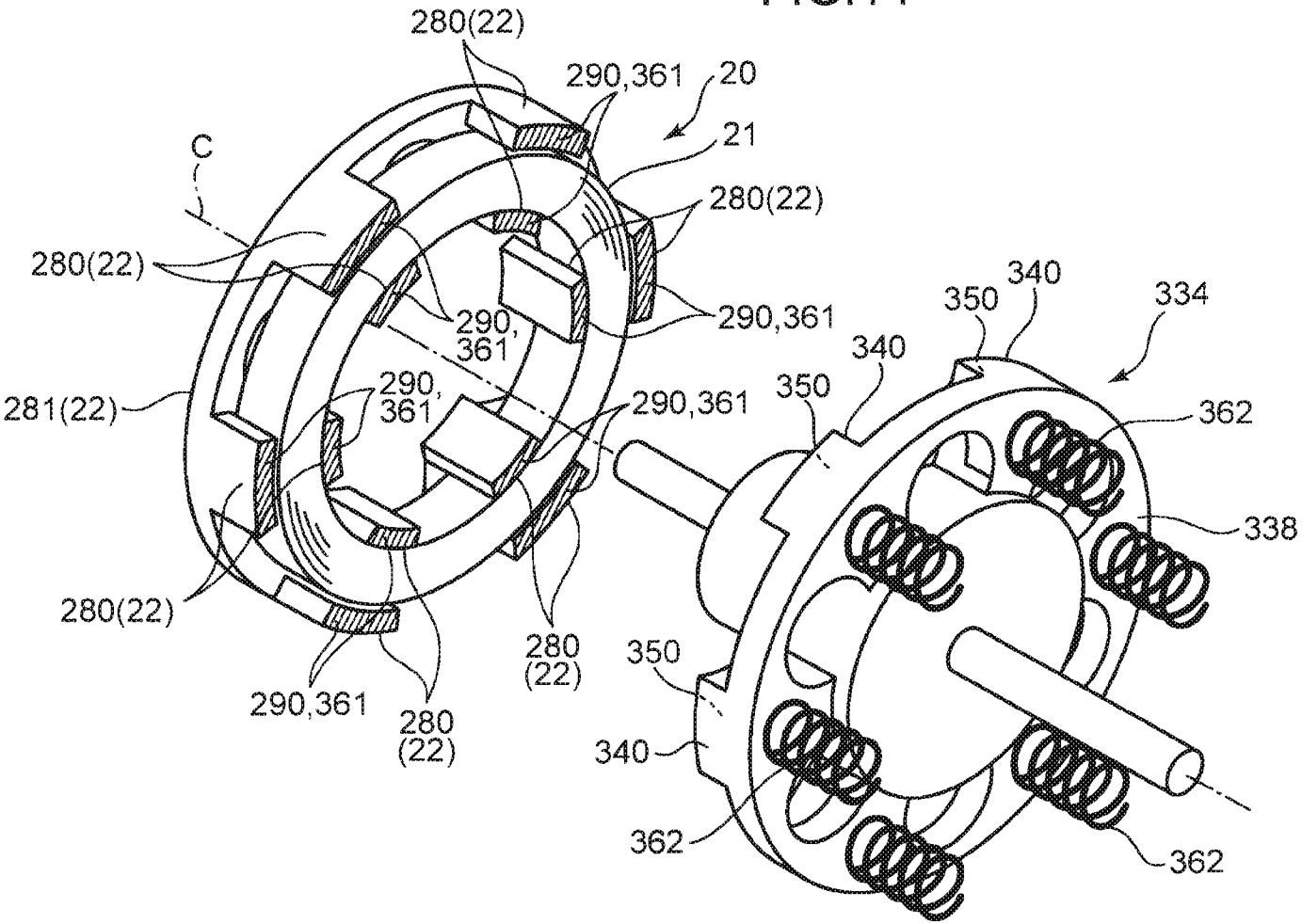
FIG. 14 is an exploded perspective view of a stator section and a rotor of a force-sense-imparting operation device according to the modification.

A further modification of an operation device utilizing the drive principle of an axial gap-type switched reluctance motor is shown in FIGS. 12 to 14.

As shown in FIG. 12, an operation device 10C according to the present modification has a similar external appearance to the operation device 10 according to the embodiment described earlier shown in FIG. 1. The operation device 10C includes the stator section (stationary section) 20 (refer to FIGS. 13 and 14), the rotor section (rotating section) 30 rotatable around the rotational axis C, the operation lever (operation member) 12, a clearance maintaining mechanism 360 (refer to FIGS. 13 and 14), a holder section 40, a rotation angle detecting section 14, a load detecting section 16, and a control section 18.

The stator section 20 is fixed to one of the supporting plates 42 of the holder section 40. As shown in FIG. 13, the stator section 20 includes the stator main body 22 and the excitation coil 21 provided on the stator main body 22.

The stator main body 22 includes a plurality of stator-side magnetic pole sections 280, a stator base section 281, and a pair of supporting sections 283.

The plurality of stator-side magnetic pole sections 280 have a similar configuration to the plurality of stator-side magnetic pole sections 280 in the operation device 10B described above.

The stator base section 281 is formed in a ring shape as shown in FIG. 14. The stator base section 281 is provided in a state where an axial center thereof coincides with the rotational axis C. The stator base section 281 connects the respective stator-side magnetic pole sections 280. In other words, the respective stator-side magnetic pole sections 280 protrude from a surface on one side of the stator base section 281 in the direction of the rotational axis C. The respective stator-side magnetic pole sections 280 are arranged at equal intervals in the circumferential direction of the stator base section 281. A stator-side magnetic pole surface 290 at a tip of each stator-side magnetic pole section 280 is arranged so as to constitute a plane that is perpendicular to the rotational axis C.

The pair of supporting sections 283 (refer to FIG. 13) is a pair of portions which are fixed to the supporting plate 42 and which support the stator base section 281 with respect to the supporting plate 42. Each supporting section 283 extends toward an opposite side to the stator-side magnetic pole section 280 from a surface of the stator base section 281 on an opposite side to the stator-side magnetic pole section 280. Each supporting section 283 is provided at a position corresponding to each arc-shaped guide hole 37 formed on the side plate 32.

Each supporting section 283 includes an engaging section 284 which is inserted to a corresponding arc-shaped guide hole 37 and which engages with the guide hole 37. The engaging section 284 is formed in a columnar shape having an outer diameter that is approximately equal to a width of the arc-shaped guide hole 37. Each supporting section 283 includes a portion that extends toward an opposite side to the stator base section 281 from the engaging section 284. In other words, each supporting section 283 includes a portion that protrudes outward from a corresponding side plate 32. This portion is fixed to the supporting plate 42.

The excitation coil 21 is attached to the stator main body 22 as shown in FIGS. 13 and 14. The excitation coil 21 is attached to the stator-side magnetic pole section 280 of the stator main body 22 by a similar structure to the attachment structure of the excitation coil 21 in the operation device 10B described above.

The rotor section 30 is configured so as to be rotatable around the rotational axis C with respect to the stator section 20. The rotor section 30 includes a cylindrical body 330, the pair of side plates 32, a shaft section 332, and a rotor 334.

The cylindrical body 330 is a cylindrical member. The cylindrical body 330 is fixed to the pair of side plates 32 in a state where the cylindrical body 330 is sandwiched between the pair of side plates 32. The cylindrical body 330 and the pair of side plates 32 are arranged so that respective axial centers thereof coincide with the rotational axis C.

The stator base section 281, the stator-side magnetic pole section 280, and a specific portion of the pair of supporting sections 283 positioned between the engaging section 284 and the stator base section 281 are inserted into the cylindrical body 330. In this state, the cylindrical body 330 is configured so as to be rotatable with respect to the stator base section 281 and each stator-side magnetic pole section 280 around the rotational axis C while an inner peripheral surface of the cylindrical body 330 slides against an outer surface of each stator-side magnetic pole section 280 and an outer surface of each supporting section 283. In other words, the cylindrical body 330 is configured so as to be rotatable around the rotational axis C while being supported from inside by the stator base section 281, each stator-side magnetic pole section 280, and each supporting section 283 of the stator section 20. Due to the configuration of the cylindrical body 330 and the configuration in which the engaging section 284 of each supporting section 283 is inserted into a corresponding arc-shaped guide hole 37, the rotor section 30 is rotatable with respect to the holder section 40 (the supporting plate 42) and the stator section 20. The operation lever 12 (refer to FIG. 12) extends in the radial direction from an outer peripheral surface of the cylindrical body 330. The structure related to the rotor 31 outside of the rotor section 30 in the operation device 10 according to the embodiment described earlier is similarly applied to a structure related to the cylindrical body 330 outside of the rotor section 30.

The shaft section 332 penetrates the pair of side plates 32 and passes through the cylindrical body 330, and is arranged so that an axial center of the shaft section 332 coincides with the rotational axis C. Both end portions of the shaft section 332 are coupled to respectively corresponding side plates 32.

The rotor 334 basically has a similar configuration to the rotor section 30 of the operation device 10B described earlier. The rotor 334 is housed in the cylindrical body 330 so that an axial center of the rotor 334 coincides with an axial center of the cylindrical body 330. The rotor 334 is held by an inner peripheral surface of the cylindrical body 330 so as to be displaceable in an axial direction of the cylindrical body 330 or, in other words, the direction of the rotational axis C. In other words, the rotor 334 is configured so as to be slidable with respect to the cylindrical body 330 in the direction of the rotational axis C. The rotor 334 includes a rotor base section 338 and a plurality of rotor-side magnetic pole sections 340 that protrude from the rotor base section 338.

The rotor base section 338 is formed in a ring shape. The rotor base section 338 is provided in a state where an axial center thereof coincides with the rotational axis C. Each rotor-side magnetic pole section 340 protrudes from a surface facing a side of the stator section 20 of the rotor base section 338. The rotor-side magnetic pole sections 340 are arranged at equal intervals in the circumferential direction of the rotor base section 338. A rotor-side magnetic pole surface 350 at a tip of each rotor-side magnetic pole section 340 is arranged so as to constitute a plane perpendicular to the rotational axis C. The rotor-side magnetic pole surface 350 of each rotor-side magnetic pole section 340 faces a nonmagnetic layer 361 (to be described later) and the stator-side magnetic pole surface 290 in the direction of the rotational axis C.

In addition, the rotor 334 is configured so as to be integrally rotatable with the cylindrical body 330 around the rotational axis C. Specifically, the rotor 334 includes a projecting portion (not shown) that protrudes outward in the radial direction from an outer peripheral surface of the rotor base section 338. The projecting portion engages with a groove portion (not shown) formed on the inner peripheral surface of the cylindrical body 330 so as to extend in the direction of the rotational axis C. Due to the engagement of the groove portion and the projecting portion of the rotor 334, the rotor 334 is configured so as to be integrally rotatable with the cylindrical body 330. In addition, when the rotor 334 is displaced in the direction of the rotational axis C, the projecting portion of the rotor 334 slides in the groove portion of the cylindrical body 330 so that the displacement of the rotor 334 in the direction of the rotational axis C is guided.

The clearance maintaining mechanism 360 maintains a constant clearance between the stator-side magnetic pole section 280 and the rotor-side magnetic pole section 340 in the direction of the rotational axis C (the direction in which the rotational axis C extends). Specifically, the clearance maintaining mechanism 360 maintains a constant clearance between each stator-side magnetic pole surface 290 and each opposing rotor-side magnetic pole surface 350 in the direction of the rotational axis C.

The clearance maintaining mechanism 360 includes the nonmagnetic layer 361 and a plurality of biasing members 362.

The nonmagnetic layer 361 is interposed between each stator-side magnetic pole surface 290 and each rotor-side magnetic pole surface 350. The nonmagnetic layer 361 forms a nonmagnetic region or, in other words, a magnetic gap (an axial gap) between the stator-side magnetic pole surface 290 and the rotor-side magnetic pole surface 350.

Figure 15:
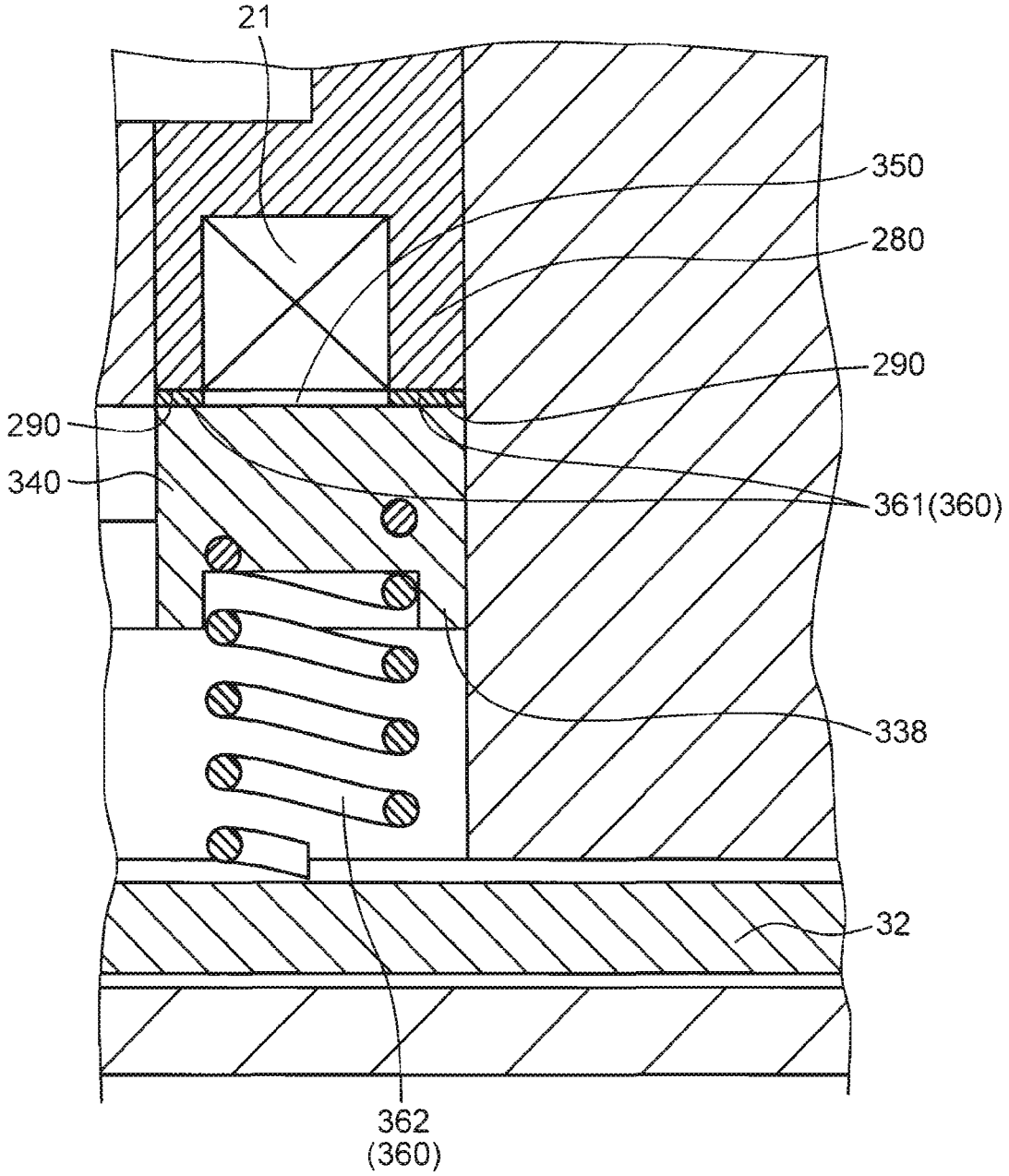
FIG. 15 is an enlarged view at portion XV in FIG. 13.

In addition, the nonmagnetic layer 361 has an extremely small coefficient of friction as compared to the stator-side magnetic pole section 280 and the rotor-side magnetic pole section 340. In the present embodiment, the nonmagnetic layer 361 is a thin resin film formed by coating the stator-side magnetic pole surface 290 (refer to FIG. 15) with PTFE (Polytetrafluoroethylene) resin and baking the coated stator-side magnetic pole surface 290. Moreover, besides PTFE resin, a resin material with a small coefficient of friction such as POM (Polyoxymethylene) and nylon which are used in resin sliding bearings can be used as the material of the nonmagnetic layer 361. However, among such resin materials, PTFE resin has a lowest coefficient of friction in a solid state and is therefore optimal as the material of the nonmagnetic layer 361.

The plurality of biasing members 362 are elastically deformable in the direction of the rotational axis C. The plurality of biasing members 362 bias the rotor 334 to the side of the stator section 20 so as to maintain a state where the nonmagnetic layer 361 is sandwiched by the stator-side magnetic pole surface 290 and the rotor-side magnetic pole surface 350. Each biasing member 362 is made of a compression coil spring. Each biasing member 362 is provided in the rotor section 30 (in the cylindrical body 330) so that the biasing member 362 is elastically deformable (extendible and contractible) in the direction of the rotational axis C and that a direction in which the biasing member 362 generates a resilient force (biasing force) coincides with the direction of the rotational axis C. In addition, each biasing member 362 is interposed between the side plate 32 that is separated from the stator section 20 in the direction of the rotational axis C among the pair of side plates 32 and the rotor base section 338 of the rotor 334. Furthermore, the plurality of biasing members 362 are arranged at equal intervals in the circumferential direction of the rotor 334. Specifically, one biasing member 362 is provided at each site corresponding to each rotor-side magnetic pole section 340. Each biasing member 362 biases (presses) the rotor 334 toward the side of the stator section 20 (the side of the stator-side magnetic pole section 280) in the direction of the rotational axis C.

Due to each biasing member 362 biasing the rotor 334 toward the side of the stator section 20, the rotor-side magnetic pole surface 350 of each rotor-side magnetic pole section 340 is pressed against the nonmagnetic layer 361.

Accordingly, a nonmagnetic clearance corresponding to a thickness of the nonmagnetic layer 361 is maintained between each stator-side magnetic pole section 290 and each rotor-side magnetic pole section 340 in the direction of the rotational axis C. In addition, even when the stator section 20 or the rotor 334 thermally expands in the direction of the rotational axis C due to a rise in temperature, the thermal expansion is absorbed by contraction of each biasing member 362 in the direction of the rotational axis C. Furthermore, even when the stator section 20 or the rotor 334 contracts in the direction of the rotational axis C due to a drop in temperature, each biasing member 362 elongates in the direction of the rotational axis C so as to keep pressing the rotor 334 to the side of the stator section 20 and, accordingly, the clearance corresponding to a thickness of the nonmagnetic layer 361 between each stator-side magnetic pole section 290 and each rotor-side magnetic pole section 340 is maintained.

Configurations of portions of the operation device 10C other than those described above are similar to configurations of corresponding portions of the operation devices 10, 10A, and 10B described earlier.

With the configuration of the operation device 10C according to the modification described above, even when a change in dimensions of the stator section 20 and the rotor 334 in the direction of the rotational axis C occurs due to a change in temperature, the clearance between the stator-side magnetic pole section 280 and the rotor-side magnetic pole section 340 in the direction of the rotational axis C can be kept constant. Specifically, a state where a magnetic gap (a nonmagnetic clearance) in the direction of the rotational axis C is secured between the stator-side magnetic pole section 280 and the rotor-side magnetic pole section 340 is maintained by biasing of the rotor 334 toward the side of the stator section 20 by the biasing members 362, the gap exactly corresponding to a thickness of the nonmagnetic layer 361 interposed between the stator-side magnetic pole surface 290 and the rotor-side magnetic pole surface 350. Therefore, a fluctuation in magnetoresistance between the stator-side magnetic pole section 280 and the rotor-side magnetic pole section 340 due to the effect of a change in temperature can be prevented.

In addition, since the nonmagnetic layer 361 has a low coefficient of friction, even when the rotor 334 is pressed to the side of the stator-side magnetic pole section 280 by the biasing members 362, a state where the rotor 334 is relatively movable in a smooth manner with respect to the stator section 20 is maintained.

Figure 16:
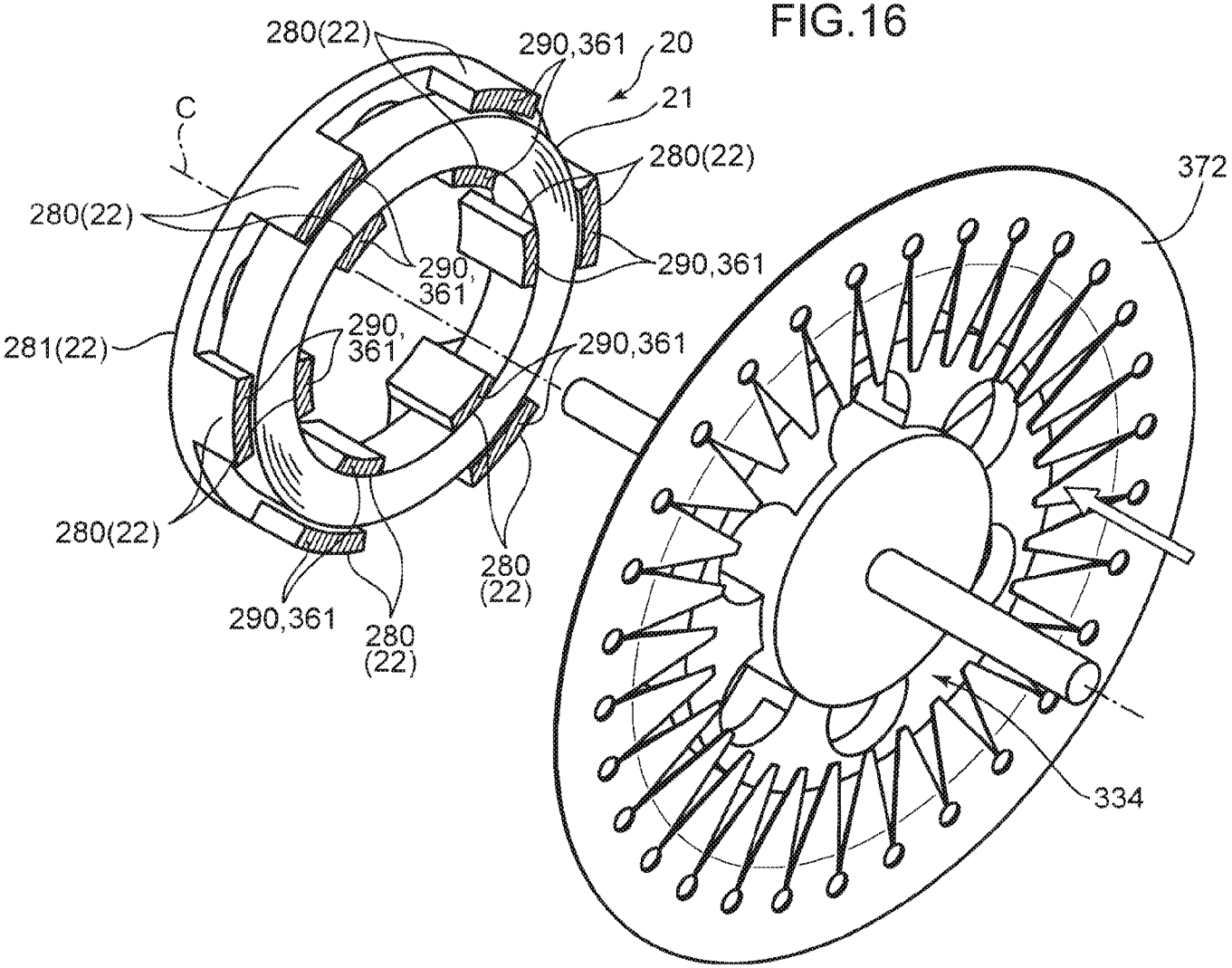
FIG. 16 is a diagram corresponding to FIG. 14 of a force-sense-imparting operation device according to another modification.

Moreover, while compression coil springs are used as the biasing members 362 in the operation device 10C described above, biasing members other than compression coil springs may be used. For example, as shown in FIG. 16, a biasing member 372 made of a diaphragm spring that is a type of disc spring may be used. A diaphragm spring has a smaller dimension in a biasing direction than a compression coil spring. Therefore, by providing the biasing member 372 made of a diaphragm spring so that the biasing member 372 is elastically deformable in the direction of the rotational axis C and that the biasing member biases the rotor 334 toward the side of the stator section 20, downsizing of the operation device in the direction of the rotational axis C can be achieved.

In addition, as the biasing member, various known biasing members other than a compression coil spring and a diaphragm spring can be used as long as the biasing member is elastically deformable in the direction of the rotational axis C and capable of biasing the rotor 334 toward the side of the stator section 20. For example, an elastic member made of an elastic material such as rubber may be used as the biasing member.

Furthermore, the nonmagnetic layer 361 may be formed on the rotor-side magnetic pole surface 350 instead of on the stator-side magnetic pole surface 290. In addition, as the nonmagnetic layer, a spacer formed separately from the stator section 20 and the rotor 334 of a material with a low coefficient of friction may be interposed between the stator-side magnetic pole section 280 and the rotor-side magnetic pole section 340.

Figure 17A:
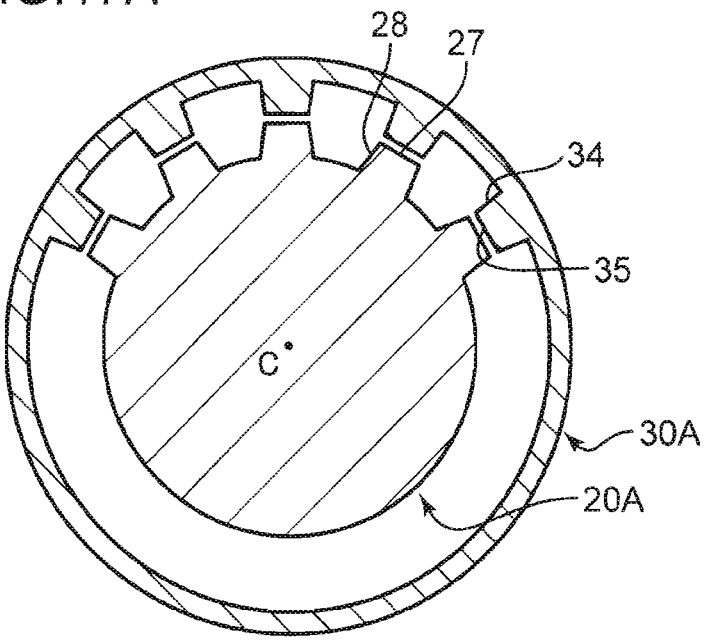
FIG. 17A is a schematic view for explaining another arrangement example of a stator-side magnetic pole section and a rotor-side magnetic pole section.
Figure 17B:
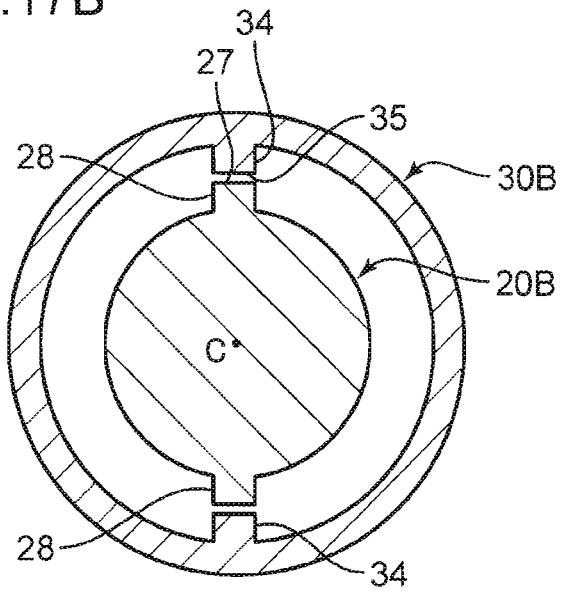
FIG. 17B is a schematic view for explaining another arrangement example of a stator-side magnetic pole section and a rotor-side magnetic pole section.
Figure 18:
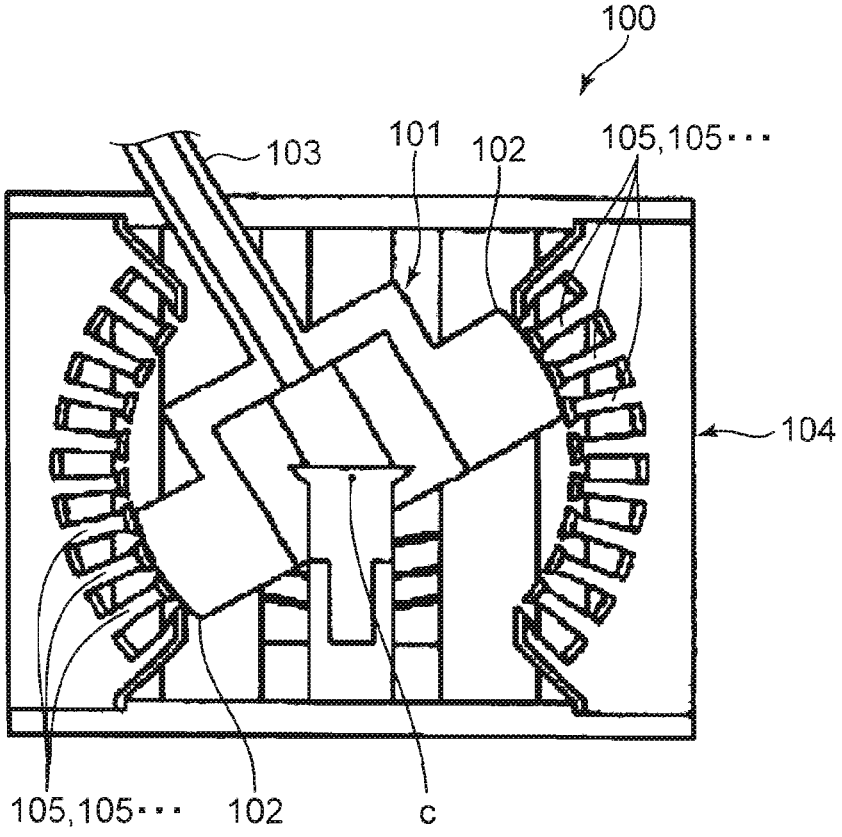
FIG. 18 is a vertical sectional view of a conventional force-sense-imparting operation device.
Figure 19:
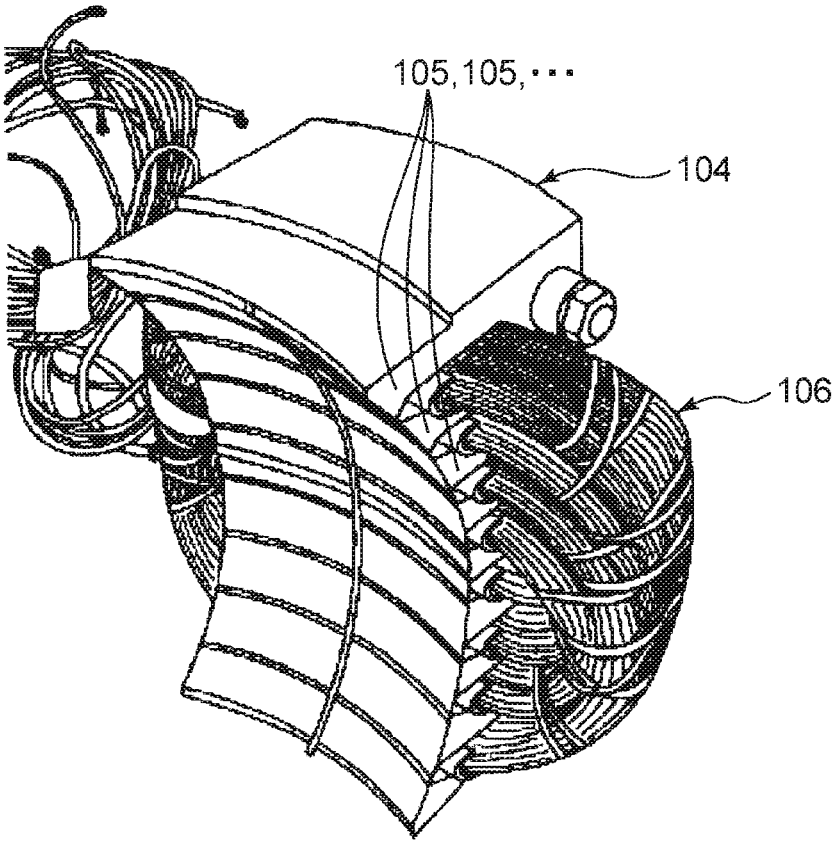
FIG. 19 is a partial enlarged perspective view for explaining an excitation coil distributedly wound around a stationary section of the conventional force-sense-imparting operation device.

While a plurality of stator-side magnetic pole sections and a plurality of rotor-side magnetic pole sections are respectively arranged at equal intervals in the circumferential direction in the operation devices 10, 10A, and 10B described above, this arrangement is not restrictive. For example, as shown in FIGS. 17A and 17B, a plurality of stator-side magnetic pole sections 28 may be arranged only on a part of a circumference in stator sections 20A and 20B, and a plurality of rotor-side magnetic pole sections 34 may be arranged in a number corresponding to the respective stator-side magnetic pole sections 28 and at positions corresponding to the respective stator-side magnetic pole sections 28 in rotor sections 30A and 30B.

In addition, a configuration may be adopted in which, for example, one each of a stator-side magnetic pole section 28 and a rotor-side magnetic pole section 34 corresponding thereto are arranged.

Moreover, the excitation coil may be provided on the side of the rotor. In this case, a rotor-side magnetic pole section at which magnetic flux lines concentrate when excited by the excitation coil corresponds to the first magnetic pole section according to the present invention and a stator-side magnetic pole section that can oppose the rotor-side magnetic pole section corresponds to the second magnetic pole section according to the present invention.

Outline of Embodiment

The embodiment described above can be summarized as follows.

A force-sense-imparting operation device according to the embodiment described above is a force-sense-imparting operation device which creates a force sense using torque generated by a magnetic force, the force-sense-imparting operation device including: a stationary section; a rotating section which is rotatable with respect to the stationary section; and an operation member for rotationally operating the rotating section. In addition, one of the stationary section and the rotating section has an excitation coil and at least one first magnetic pole section at which magnetic flux lines concentrate when the first magnetic pole section is excited by the excitation coil, the other of the stationary section and the rotating section has at least one second magnetic pole section which is capable of opposition to the first magnetic pole section in a specific opposing direction, the excitation coil has an opposing site which opposes the second magnetic pole section, the first magnetic pole section has a shape which encircles the excitation coil with the exception of the opposing site in a cross section perpendicular to a direction of flow of an excitation current in the excitation coil, and the second magnetic pole section has a shape which forms clearances in the opposing direction between the second magnetic pole section and each of the excitation coil and the first magnetic pole section when the second magnetic pole section opposes the first magnetic pole section and which forms a magnetic circuit in cooperation with the first magnetic pole section due to the second magnetic pole section being excited by the excitation coil in a state where the second magnetic pole section opposes the first magnetic pole section, the magnetic circuit encircling a periphery of the excitation coil on the cross section, the second magnetic pole section being arranged so as to separate from the first magnetic pole section with rotation of the rotating section.

According to this configuration, as the rotating section rotates with respect to the stationary section so that a clearance between the first magnetic pole section and the second magnetic pole section changes, magnetoresistance between the first and second magnetic pole sections increases or decreases. Using this increase or decrease in magnetoresistance, a magnetic attraction force can be applied to the rotating section in a rotational direction. As a result, a torque can be created at the rotating section. Therefore, a force sense can be imparted to the operation member for rotationally operating the rotating section without using a permanent magnet. Details are as described below.

When an excitation current is supplied to the excitation coil in a state where the first magnetic pole section and the second magnetic pole section oppose each other, magnetic flux lines created by the excitation of the excitation coil concentrate at the first magnetic pole section and the second magnetic pole section. As a result, a magnetic circuit which passes through the first magnetic pole section and the second magnetic pole section and which encircles the excitation coil is formed (for example, refer to FIG. 3). In this state, magnetoresistance between the first and second magnetic pole sections is smallest when the second magnetic pole section is arranged at a position directly in front of the first magnetic pole section or, in other words, when the second magnetic pole section is arranged at an opposing position with respect to the first magnetic pole section (for example, refer to FIG. 3). Meanwhile as the rotating section rotates so that the second magnetic pole section separates from the first magnetic pole section, the magnetoresistance between the first and second magnetic pole sections increases. Therefore, when an excitation current is supplied to the excitation coil as the rotating section is rotationally operated (rotated) by the operation member, a magnetic attraction force between the first and second magnetic pole sections corresponding to each other acts in a direction which reduces magnetoresistance. Consequently, the magnetic attraction force acts on the rotating section in a direction in which the second magnetic pole section moves toward a position directly in front of the first magnetic pole section. As a result, a torque is created at the rotating section and a force sense is imparted to the operation member rotationally operated by an operator or the like.

As shown, with the force-sense-imparting operation device according to the embodiment described above, a magnetic attraction force can be created to generate a torque at the rotating section without using a permanent magnet and, as a result, force sense presentation through the operation member can be performed.

In addition, even during a current runaway where an excitation current greater than a scheduled current is supplied to the excitation coil, since only a torque in a direction in which the second magnetic pole section is returned to the front position is created at the rotating section, the operation member can be stopped at a position coinciding with the return of the second magnetic pole section to the front position. In other words, the operation member can be prevented from moving in an unintended direction even during a current runaway.

In the force-sense-imparting operation device according to the embodiment described above, the excitation coil and the first magnetic pole section may be provided at the stationary section, and the second magnetic pole section may be provided at the rotating section.

In addition, in the force-sense-imparting operation device according to the embodiment described above, favorably, the at least one first magnetic pole section includes a plurality of first magnetic pole sections which are provided at a plurality of positions arranged at intervals in a rotational direction of the rotating section, the at least one second magnetic pole section includes a plurality of second magnetic pole sections which are provided at the same number of positions as the first magnetic pole sections arranged at intervals in the rotational direction, and each interval between the second magnetic pole sections mutually adjacent in the rotational direction is set so that, when one of the second magnetic pole sections opposes the first magnetic pole section corresponding thereto, the remaining second magnetic pole sections oppose corresponding first magnetic pole sections, respectively.

According to this configuration, when the first and second magnetic pole sections are excited by the excitation coil, a magnetic attraction force is respectively generated for each combination of the first magnetic pole section and the second magnetic pole section which correspond to each other. Therefore, a large torque can be created at the rotating section in an efficient manner.

In this case, favorably, the force-sense-imparting operation device further includes a rotation angle restricting section which restricts a rotation angle of the rotating section within a prescribed angle range, and the prescribed angle range is such an angle range that a magnetic attraction force which the second magnetic pole section receives from the first magnetic pole section adjacent to the first magnetic pole section corresponding to the second magnetic pole section is smaller than a magnetic attraction force which the second magnetic pole section receives from the corresponding first magnetic pole section.

According to this configuration, an occurrence of cogging can be prevented.

In addition, in the force-sense-imparting operation device described above, the specific opposing direction may correspond to a radial direction of a circle along a rotational direction of the rotating section.

According to this configuration, compared to a case where the specific opposing direction is a direction of a rotational axis of the rotating section, a dimension of the force-sense-imparting operation device in the direction of the rotational axis can be suppressed.

In this case, favorably, the rotating section encircles the stationary section in the rotational direction at an outer side of the stationary section in the radial direction and the operation member is attached to an outer peripheral surface of the rotating section. In addition, the operation member may extend outward in the radial direction from the outer peripheral surface of the rotating section.

According to this configuration, compared to a configuration in which the operation member is extended from the rotating section arranged on an inner side in the radial direction of the stationary section to an outer side of the stationary section, a construction of the operation member can be simplified.

Furthermore, in the force-sense-imparting operation device described above, the specific opposing direction may correspond to a direction of a rotational axis of the rotating section, the first magnetic pole section and the second magnetic pole section may be provided so as to be relatively displaceable from each other in the direction of the rotational axis, and the force-sense-imparting operation device may further include a clearance maintaining mechanism which maintains a constant clearance between the first magnetic pole section and the second magnetic pole section in the direction of the rotational axis.

According to this configuration, even when a change in dimensions of the stationary section and the rotating section in the direction of the rotational axis occurs due to a change in temperature, the clearance between the first magnetic pole section and the second magnetic pole section in the direction of the rotational axis can be kept constant. As a result, fluctuation of the magnetoresistance between the first magnetic pole section and the second magnetic pole section attributable to the effect of the change in temperature can be prevented.

In this case, favorably, the clearance maintaining mechanism includes: a nonmagnetic layer interposed between the first magnetic pole section and the second magnetic pole section in the direction of the rotational axis; and a biasing member which is elastically deformable in the direction of the rotational axis and which biases one of the first magnetic pole section and the second magnetic pole section toward the other magnetic pole section side so that a state where the nonmagnetic layer is sandwiched by the first magnetic pole section and the second magnetic pole section is maintained.

According to this configuration, a state can be maintained where a nonmagnetic region with a constant width is secured by the nonmagnetic layer in the direction of the rotational axis between the first magnetic pole section and the second magnetic pole section.

Furthermore, in this case, favorably, the nonmagnetic layer has a lower coefficient of friction than coefficients of friction of the first magnetic pole section and the second magnetic pole section.

According to this configuration, even when the first magnetic pole section and the second magnetic pole section are pressed against each other by the biasing member, a state where both magnetic pole sections are relatively rotatable in a smooth manner can be maintained by the nonmagnetic layer having a lower coefficient of friction than the coefficients of friction of the magnetic pole sections.

In addition, the force-sense-imparting operation device may include: a rotation angle detecting section which detects a rotation angle of the rotating section; and a control section which adjusts an excitation current to be supplied to the excitation coil based on a result of detection by the rotation angle detecting section.

According to this configuration, a magnitude of a force sense imparted to the operation member can be adjusted by adjusting a magnitude of a torque created at the rotating section in accordance with a rotational operation (amount of rotation) of the rotating section by the operation member.

In this case, by adopting a configuration where the rotation angle detecting section is attached to the rotating section, an arrangement space of the rotation angle detecting section can be suppressed. In addition, a generic, inexpensive encoder can also be used as the rotation angle detecting section.

In addition, the force-sense-imparting operation device may further include a load detecting section which detects a load on an operated section of a working machine which is operated by the force-sense-imparting operation device, and the control section may be operative to adjust an excitation current to be supplied to the excitation coil based on a result of detection by the load detecting section.

According to this configuration, a magnitude of a force sense imparted to the operation member can be adjusted by adjusting a magnitude of a torque created at the rotating section in accordance with the load.

As described above, according to the embodiment, a force-sense-imparting operation device capable of imparting a force sense to an operation member without using a permanent magnet can be provided.

The invention claimed is:

1. A force-sense-imparting operation device which creates a force sense using torque generated by a magnetic force, the force-sense-imparting operation device comprising:

a stationary section;

a rotating section which is rotatable with respect to the stationary section; and an operation member for rotationally operating the rotating section, wherein only one of the stationary section and the rotating section has an excitation coil and at least one first magnetic pole section at which magnetic flux lines concentrate when the first magnetic pole section is excited by the excitation coil, the other of the stationary section and the rotating section has at least one second magnetic pole section which is capable of opposition to the first magnetic pole section in a specific opposing direction, the excitation coil has an opposing site which opposes the second magnetic pole section, the first magnetic pole section has a shape which encircles the excitation coil with the exception of the opposing site in a cross section perpendicular to a direction of flow of an excitation current in the excitation coil, and the second magnetic pole section has a shape which forms clearances in the opposing direction between the second magnetic pole section and each of the excitation coil and the first magnetic pole section when the second magnetic pole section opposes the first magnetic pole section and which forms a magnetic circuit in cooperation with the first magnetic pole section due to both the first magnetic pole section and the second magnetic pole section being excited by the excitation coil in a state where the second magnetic pole section opposes the first magnetic pole section, the magnetic circuit encircling a periphery of the excitation coil on the cross section, the second magnetic pole section being arranged so as to separate from the first magnetic pole section with rotation of the rotating section.

2. The force-sense-imparting operation device according to claim 1, wherein the excitation coil and the first magnetic pole section are provided at the stationary section, and the second magnetic pole section is provided at the rotating section.

3. The force-sense-imparting operation device according to claim 1, wherein the at least one first magnetic pole section includes a plurality of first magnetic pole sections which are provided at a plurality of positions arranged at intervals in a rotational direction of the rotating section, the at least one second magnetic pole section includes a plurality of second magnetic pole sections which are provided at the same number of positions as the first magnetic pole sections arranged at intervals in the rotational direction, and each interval between the second magnetic pole sections mutually adjacent in the rotational direction is set so that, when one of the second magnetic pole sections opposes the first magnetic pole section corresponding thereto, the remaining second magnetic pole sections oppose corresponding first magnetic pole sections, respectively.

4. The force-sense-imparting operation device according to claim 3, further comprising a rotation angle restricting section which restricts a rotation angle of the rotating section within a prescribed angle range, wherein the prescribed angle range is such an angle range that a magnetic attraction force which the second magnetic pole section receives from the first magnetic pole section adjacent to the first magnetic pole section corresponding to the second magnetic pole section is smaller than a magnetic attraction force which the second magnetic pole section receives from the corresponding first magnetic pole section.

5. The force-sense-imparting operation device according to claim 1, wherein the specific opposing direction is a radial direction of a circle along a rotational direction of the rotating section.

6. The force-sense-imparting operation device according to claim 5, wherein the rotating section encircles the stationary section in the rotational direction at an outer side of the stationary section in the radial direction, and the operation member is attached to an outer peripheral surface of the rotating section.

7. The force-sense-imparting operation device according to claim 1, wherein the specific opposing direction is a direction of a rotational axis of the rotating section, the first magnetic pole section and the second magnetic pole section are provided so as to be relatively displaceable from each other in the direction of the rotational axis, and the force-sense-imparting operation device further comprises a clearance maintaining mechanism which maintains a constant clearance between the first magnetic pole section and the second magnetic pole section in the direction of the rotational axis.

8. The force-sense-imparting operation device according to claim 7, wherein the clearance maintaining mechanism includes: a nonmagnetic layer interposed between the first magnetic pole section and the second magnetic pole section in the direction of the rotational axis; and a biasing member which is elastically deformable in the direction of the rotational axis and which biases one of the first magnetic pole section and the second magnetic pole section toward the other magnetic pole section so that a state where the nonmagnetic layer is sandwiched by the first magnetic pole section and the second magnetic pole section is maintained.

9. The force-sense-imparting operation device according to claim 8, wherein the nonmagnetic layer has a lower coefficient of friction than coefficients of friction of the first magnetic pole section and the second magnetic pole section.

10. The force-sense-imparting operation device according to claim 1, comprising:

a rotation angle detecting section which detects a rotation angle of the rotating section; and a control section which adjusts an excitation current to be supplied to the excitation coil based on a result of detection by the rotation angle detecting section.

11. The force-sense-imparting operation device according to claim 10, wherein the rotation angle detecting section is attached to the rotating section.

12. The force-sense-imparting operation device according to claim 10, further comprising a load detecting section which detects a load on an operated section of a working machine which is operated by the force-sense-imparting operation device, wherein the control section is operative to adjust an excitation current to be supplied to the excitation coil based on a result of detection by the load detecting section.

* * * * *